US006106087A

United States Patent [19]

Kishi

[11] Patent Number: 6,106,087

[45] Date of Patent: Aug. 22, 2000

[54] DETECTION APPARATUS FOR DETECTING RESIDUAL INK QUANTITY IN INK CARTRIDGE

[75] Inventor: Motoshi Kishi, Nagoya, Japan

[73] Assignee: Brother Kogyo Kabushiki Kaisha, Nagoya, Japan

[21] Appl. No.: 08/938,969

[22] Filed: Sep. 26, 1997

[30] Foreign Application Priority Data

Oct. 1, 1996 [JP] Japan ..... 8-260386
Oct. 18, 1996 [JP] Japan ..... 8-275953

[51] Int. Cl.[7] ..... B41J 2/195

[52] U.S. Cl. ..... 347/7; 73/290 R; 118/694

[58] Field of Search ..... 347/7; 399/57; 118/694; 73/290 R, 304 R, 304 C; 340/618, 620

[56] References Cited

U.S. PATENT DOCUMENTS 4,626,874 12/1986 Murai et al. ..... 347/7
4,788,861 12/1988 Lichti ..... 347/7 X
4,853,718 8/1989 ElHatem et al. ..... 347/7
5,051,759 9/1991 Karita et al. ..... 347/7
5,289,211 2/1994 Morandotti et al. ..... 347/7
5,623,291 4/1997 Morandotti et al. ..... 347/7
5,724,076 3/1998 Ishida ..... 347/7

FOREIGN PATENT DOCUMENTS 2-107452 4/1990 Japan .
2-275318 11/1990 Japan .
3-251461 11/1991 Japan .

*Primary Examiner*—William J. Royer
*Attorney, Agent, or Firm*—Oliff & Berridge, PLC

[57] ABSTRACT

A detection apparatus that utilizes a CR oscillating circuit and detects residual ink quantities in an ink cartridge. The CR oscillating circuit is constructed from a capacitor C in which the capacitance value changes according to the residual ink quantity and a logic integrated circuit. A pulse signal frequency is oscillated by the logic integrated circuit based on the quantity of residual ink. Therefore, the quantity of residual ink is detected by counting the number of pulses of the pulse signal over a predetermined period of time based on the frequency of the pulse signal output from the logic integrated circuit. Thereby, digital processing can be conducted by directly using logic signals output from the logic integrated circuit without using an A/D converter.

42 Claims, 19 Drawing Sheets

INK EXISTS

INK DOES NOT EXIST
Vcc
OV
α
β
ta1
ta2
Ta
tb1
tb2
Tb
0
10
20
TIME (msec)

INK EXISTS

INK DOES NOT EXIST
Vcc
0V
α
β
tc1
tc2
Tc
td1
td2
Td
0
10
20
TIME (msec)

(PRIOR ART)

DETECTION APPARATUS FOR DETECTING RESIDUAL INK QUANTITY IN INK CARTRIDGE

BACKGROUND OF THE INVENTION

1. Field of the Invention

The present invention relates to a detection apparatus installed in an ink jet printer for detecting residual ink quantity in an ink cartridge supplying ink to an ink jet head, and in particular, relates to a detection apparatus capable of inputting the detected residual ink data directly to a control device of the ink jet printer, thereby the control device can digitally process the residual ink data and the detection apparatus can be simply constructed with low cost, without an A/D converting device such as an A/D converter to conduct A/D conversion of the residual ink data.

2. Description of Related Art

Conventionally, in a printing apparatus such as an ink jet printer, an ink jet head conducts image printing on a print sheet by ejecting ink supplied from an ink cartridge filled with ink. If ink in the ink cartridge is consumed, image printing cannot continue, thus it is necessary to exchange the old ink cartridge with a new one filled with ink before ink is completely consumed, and to supply ink to the ink jet head. Therefore, it is inevitable to install in the ink jet printer an apparatus for continuously detecting residual ink quantity in the ink cartridge.

Under the above circumstance, as the detection apparatuses for detecting the residual ink quantity in the ink cartridge, there are proposed various apparatuses and methods to detect the residual ink quantity.

For example, there exists a detection apparatus that includes a pair of electrode plates that are arranged in the ink cartridge and a condenser is formed between the electrode plates in cooperation with ink, further the residual ink quantity is detected by measuring capacitance which changes according to change of the residual ink quantity. Such detection apparatus will be described with reference to FIG. 18. FIG. 18 shows a circuit diagram of the detection apparatus for detecting the residual ink quantity in the related prior art.

In FIG. 18, a detection apparatus 100 is shown for detecting the residual ink quantity in an ink cartridge 102. The detection apparatus 100 is basically constructed from a signal producing device 101, a pair of electrode plates 103 arranged in the ink cartridge 102, a detecting resistor 104 and an A/D converter 105. The signal producing device 101 produces a rectangular pulse shown in FIG. 19(A). Both the electrode plates 103 construct a condenser C in cooperation with ink filled in the ink cartridge 102. At that time, capacitance of the condenser C changes according to change of the residual ink in the ink cartridge 102. For instance, if enough ink is filled in the ink cartridge 102, the condenser C retains a predetermined capacitance value. On the other hand, if the residual ink quantity decreases by being consumed, the capacitance value of the condenser C becomes small. The detecting resistor 104 outputs to the A/D converter 105 a detecting pulse having a waveform which is rounded in comparison with the rectangular pulse and determined on the basis of the capacitance value of the condenser C and resistance value of the detecting resistor 103, as shown in FIG. 19(B). The A/D converter 105 conducts A/D conversion based on a predetermined voltage value about the detecting pulse, thereafter outputs the A/D conversion value to a control apparatus (not shown).

In the detection apparatus 100, the residual ink quantity in the ink cartridge 102 is detected as follows. That is, the capacitance value of the condenser C constructed from both the electrode plates 103 and ink therebetween becomes small as residual ink decreases, and corresponding to the above, the waveform of the detecting pulse output to the A/D converter 105 in cooperation with the detecting resistor 104 will gradually change. Thus, the residual ink quantity is detected by detecting the changing state of the waveform in the detecting pulse.

In detail, when the rectangular pulse (shown in FIG. 19(A)) is output from the signal producing device 101, the detecting pulse having a rounded waveform (shown in FIG. 19(B)) is output to the A/D converter 105 while enough ink exists in the ink cartridge 102 and the condenser C retains the predetermined capacitance value. On the contrary, when the capacitance value of the condenser C reduces according to decrease of residual ink, the round of the waveform (shown in FIG. 19(B)) in the detecting pulse gradually disappears and the waveform gradually approaches to a waveform of the rectangular pulse. Thus, the detecting pulse with the above waveform is output to the A/D converter 105 and the voltage value converted by the A/D converter 105 becomes higher than the predetermined voltage value, thereby the control apparatus can detect that residual ink is run out of the ink cartridge 102.

However, in the conventional detection apparatus 100, it is necessary to provide the A/D converter 105 which outputs digital data to the control apparatus after A/D conversion of the detecting pulse, and in addition to this, it is necessary to use an interface with complex construction. Therefore, cost of the detection apparatus cannot be reduced and control for detecting the residual ink quantity becomes complex.

Further, as the other detection apparatuses for detecting the residual ink quantity, there are utilized, for example, methods to detect an ink liquid surface by detecting a float having a magnet therein which is movable according to change of the ink liquid surface through a lead switch, or to detect the ink liquid surface through a light sensor. But, in such detection apparatuses, it is necessary to assemble complex parts, thus apparatuses are liable to go wrong. Further, light from the light sensor cannot correctly transmit due to ink attached to the walls of the ink cartridge, as a result, the residual ink quantity cannot be correctly detected.

Under the above circumstance, in order to dissolve the above problems, it is conventionally proposed another type of detection apparatus for detecting the residual ink quantity. In this type of detection apparatus, it is utilized a detection circuit is utilized in which two electrode plates are arranged in the ink cartridge with difference of elevation. The detection circuit detects a resistance value between the electrode plates and guesses the residual ink quantity on the basis of the resistance value. Here, it is known that ink is generally not both a good conductor and an insulating material against electricity, and becomes a conductor with a predetermined resistance value. Therefore, the resistance value between the electrode plates changes according to ink quantity existing therebetween, thus the residual ink quantity can be detected by applying a signal to the detection circuit and measuring the change of resistance value between the electrode plates.

However, in the detection apparatus having the electrode plates in the ink cartridge, though residual ink quantity can be detected with high reliability, there is a problem that a control part for judging change of resistance value inevitably becomes complex. The reason is as follows. That is, the detected signal output from the detection circuit is an analog signal which corresponds to the voltage value change on the basis of the resistance value change between the electrode plates. Therefore, control apparatuses in printers cannot directly process such an analog signal. Thus, it is necessary in the control circuit to provide a converting device such as an A/D converter for converting the analog signal into a digital signal. In addition to this, it is necessary to use an interface with complex construction. Therefore, the detection apparatus inevitably becomes complex and large-scale, and the cost thereof cannot be reduced.

SUMMARY OF THE INVENTION

Accordingly, it is an object of the present invention to overcome the above mentioned problems and to provide a detection apparatus in which the detected residual ink data is logic data capable of digital processing and thus can be directly input to the control device in the ink jet printer, thereby the control device can digitally process the residual ink data and the detection apparatus can be simply constructed with low cost, without an A/D converting device such as an A/D converter to conduct A/D conversion of the residual ink data.

To accomplish the above objects, the present invention provides a detection apparatus for detecting residual ink quantity in an ink cartridge supplying ink to an ink jet head, the detection apparatus comprising:

pulse oscillation means for oscillating a pulse signal with a frequency which changes corresponding to the residual ink quantity, the pulse oscillation means including a CR oscillation circuit having a condenser in which a capacitance changes corresponding to the residual ink quantity in the ink cartridge; and detection means for detecting the residual ink quantity on the basis of the oscillating frequency of the pulse signal while receiving the pulse signal produced in the pulse oscillation means.

In the detection apparatus claimed, it utilizes the CR oscillation circuit having the condenser in which the capacitance changes according to the residual ink quantity and the pulse signal with the frequency which changes corresponding to the residual ink quantity is oscillated by the pulse oscillation means, and further the residual ink quantity is detected on the basis of the oscillating frequency of the pulse signal by the detection means.

Therefore, digital processing can be conducted by directly using the pulse signal from the pulse oscillation means, without using the A/D converter. Thereby, the detection apparatus for detecting the residual ink quantity in the ink cartridge can be simply constructed, and the apparatus can be realized with low cost and compact size. Further, since a CR oscillation circuit is used, it concludes that an alternating waveform is applied to ink in the ink cartridge, thus it can prevent ink from occurring electrolysis therein and decomposition thereof.

Further, the present invention provides a detection apparatus for detecting residual ink quantity in an ink cartridge supplying ink to an ink jet head, the detection apparatus comprising:

pulse oscillation means for oscillating a pulse signal with a frequency which changes corresponding to the residual ink quantity, the pulse oscillation means including a CR oscillation circuit having a resistor in which a resistance changes corresponding to the residual ink quantity in the ink cartridge; and detection means for detecting the residual ink quantity on the basis of the oscillating frequency of the pulse signal while receiving the pulse signal produced in the pulse oscillation means.

In the detection apparatus claimed, it utilizes the CR oscillation circuit having the resistor in which the resistance changes according to the residual ink quantity and the pulse signal with the frequency which changes corresponding to the residual ink quantity is oscillated by the pulse oscillation means, and further the residual ink quantity is detected on the basis of the oscillating frequency of the pulse signal by the detection means.

Therefore, digital processing can be conducted by directly using the pulse signal from the pulse oscillation means, without using the A/D converter. Thereby, the detection apparatus for detecting residual ink quantity in the ink cartridge can be simply constructed, and the apparatus can be realized with low cost and compact size. Further, since a CR oscillation circuit is used, it concludes that an alternating waveform is applied to ink in the ink cartridge, thus it can prevent ink from occurring electrolysis therein and decomposition thereof.

Further, the present invention provides a detection apparatus for detecting residual ink quantity in an ink cartridge supplying ink to an ink jet head, the detection apparatus comprising:

pulse product means for producing a pulse signal with a pulse width which changes corresponding to the residual ink quantity on the basis of an input signal, the pulse product means including a multivibrator circuit having a resistor in which a resistance changes corresponding to the residual ink quantity in the ink cartridge; and detection means for applying the input signal to the pulse product means and for receiving the pulse signal output from the pulse product means, the detection means detecting the residual ink quantity on the basis of the pulse width of the pulse signal.

In the detection apparatus claimed, it utilizes the multivibrator circuit having the resistor in which the resistance changes corresponding to the residual ink quantity in the ink cartridge, and the residual ink quantity is output in a form of the pulse width of the pulse signal, without using a form of voltage change. Thus, detection means can conduct digital processing by directly using the pulse signal from the pulse product means, without using the A/D converter. Thereby, the detection apparatus for detecting residual ink quantity in the ink cartridge can be simply constructed, and the apparatus can be realized with low cost and compact size.

Further, the present invention provides a detection apparatus for detecting residual ink quantity in an ink cartridge supplying ink to an ink jet head, the detection apparatus comprising:

pulse product means for producing a pulse signal with a pulse width which changes corresponding to the residual ink quantity on the basis of an input signal, the pulse product means including a multivibrator circuit having a condenser in which a capacitance changes corresponding to the residual ink quantity in the ink cartridge; and detection means for applying the input signal to the pulse product means and for receiving the pulse signal output from the pulse product means, the detection means detecting the residual ink quantity on the basis of the pulse width of the pulse signal.

In the detection apparatus claimed, it utilizes the multivibrator circuit having the condenser in which the capacitance changes corresponding to the residual ink quantity in the ink cartridge, and the residual ink quantity is output in a form of the pulse width of the pulse signal, without using a form of voltage change. Thus, detection means can conduct digital processing by directly using the pulse signal from the pulse product means, without using the A/D converter. Thereby, the detection apparatus for detecting residual ink quantity in the ink cartridge can be simply constructed, and the apparatus can be realized with low cost and compact size.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the accompanying drawings, wherein.

DETAILED DESCRIPTION OF THE PREFERRED EMBODIMENTS

A detailed description of the embodiments according to the present invention will be described with reference to the accompanying drawings. First, it will be described construction of the ink jet printer in which the detection apparatus according to each embodiment is installed, with reference to FIGS. 1–3.

Figure 1:
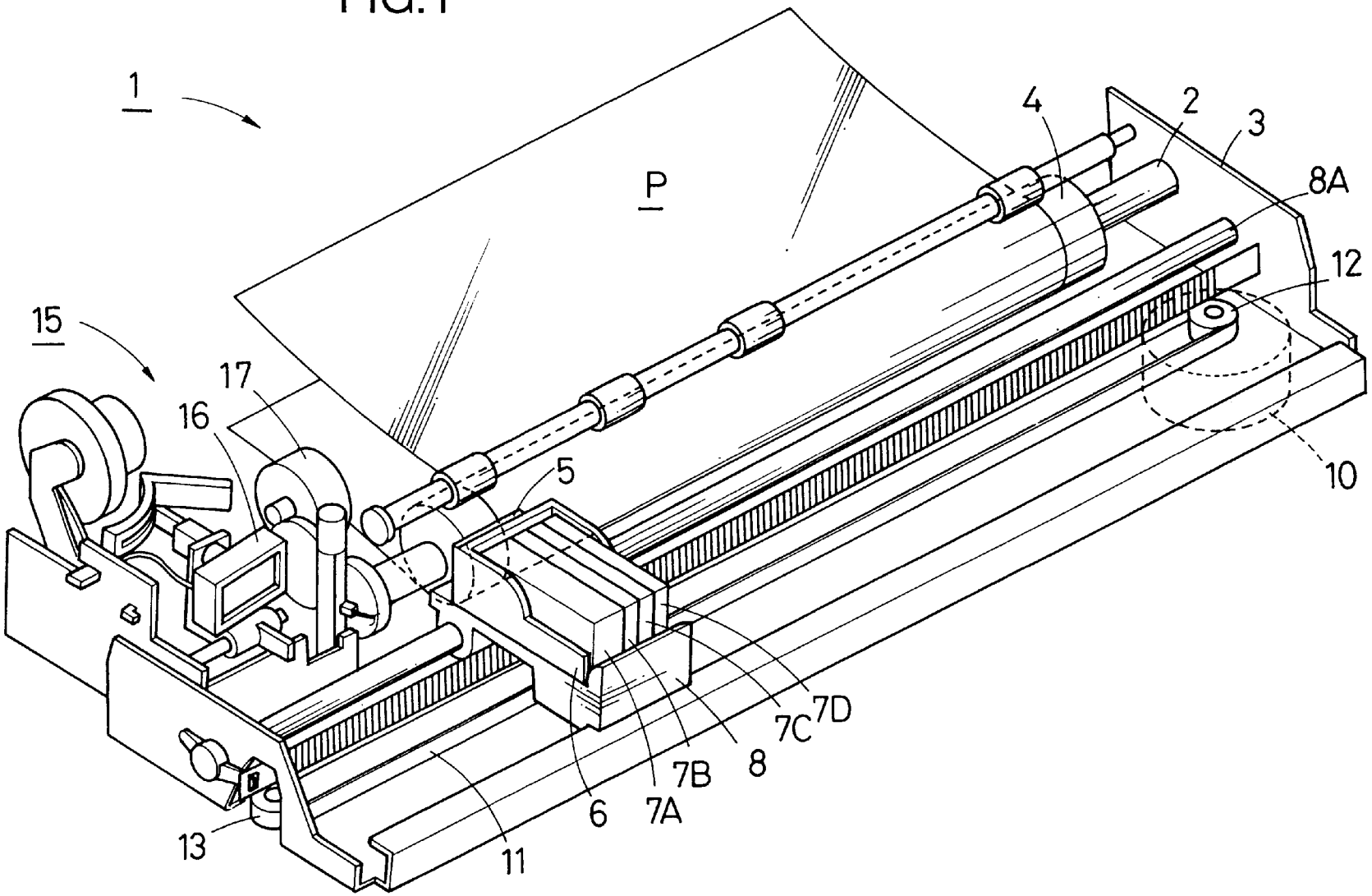
FIG. 1 is a perspective view of the ink jet printer with the detection apparatus for detecting residual ink quantity in the ink cartridge according the present invention.

In FIG. 1, the ink jet printer 1 has a platen roller 4 with a cylindrical shape which is rotatably supported to a frame 3 through a rotating shaft 2 extended in the left and right direction. The platen roller 4 feeds a print sheet P as recording medium supplied from a sheet supply cassette or a manual sheet supply part (not shown), while confronting the print sheet P against a print head 5. Thus, the platen roller 4 constructs a part of sheet feeding device. The print head 5 is detachably installed on a carriage 8 with a head unit 6 and ink cartridges 7A–7D for supplying ink with four colors (cyan, yellow, magenta and black) to the print head 5.

The front part of carriage 8 is supported to a carriage shaft 8A which is arranged parallel to an axial line of the platen roller 4, thus the print head 5 on the carriage 8 conducts printing while moving in the direction across the print sheet P supported on the platen roller 4. A carriage motor 10 drives the carriage 8 in cooperation with a belt 11 and two pulleys 12, 13.

At the left side of the platen roller 4, that is, in a range out of the recording region of the print sheet P, it is arranged a purge device 15 to recover non-ejection state or ejection trouble state of ink in the print head 5. In the purge device 15, it is arranged a suction cap 16 which covers nozzles of the print head 5 and sucks bad ink in the print head 5 by negative pressure produced through a pump, thus recovers the print head 5. The purge device 15 is driven by a line feed (LF) motor 43 (see FIG. 3) which is used for rotating the platen roller 4. Drive force of the LF motor 43 is transmitted to the purge device 15 through a pump cam gear 17 when the carriage 8 moves into a recovery region.

Figure 2:
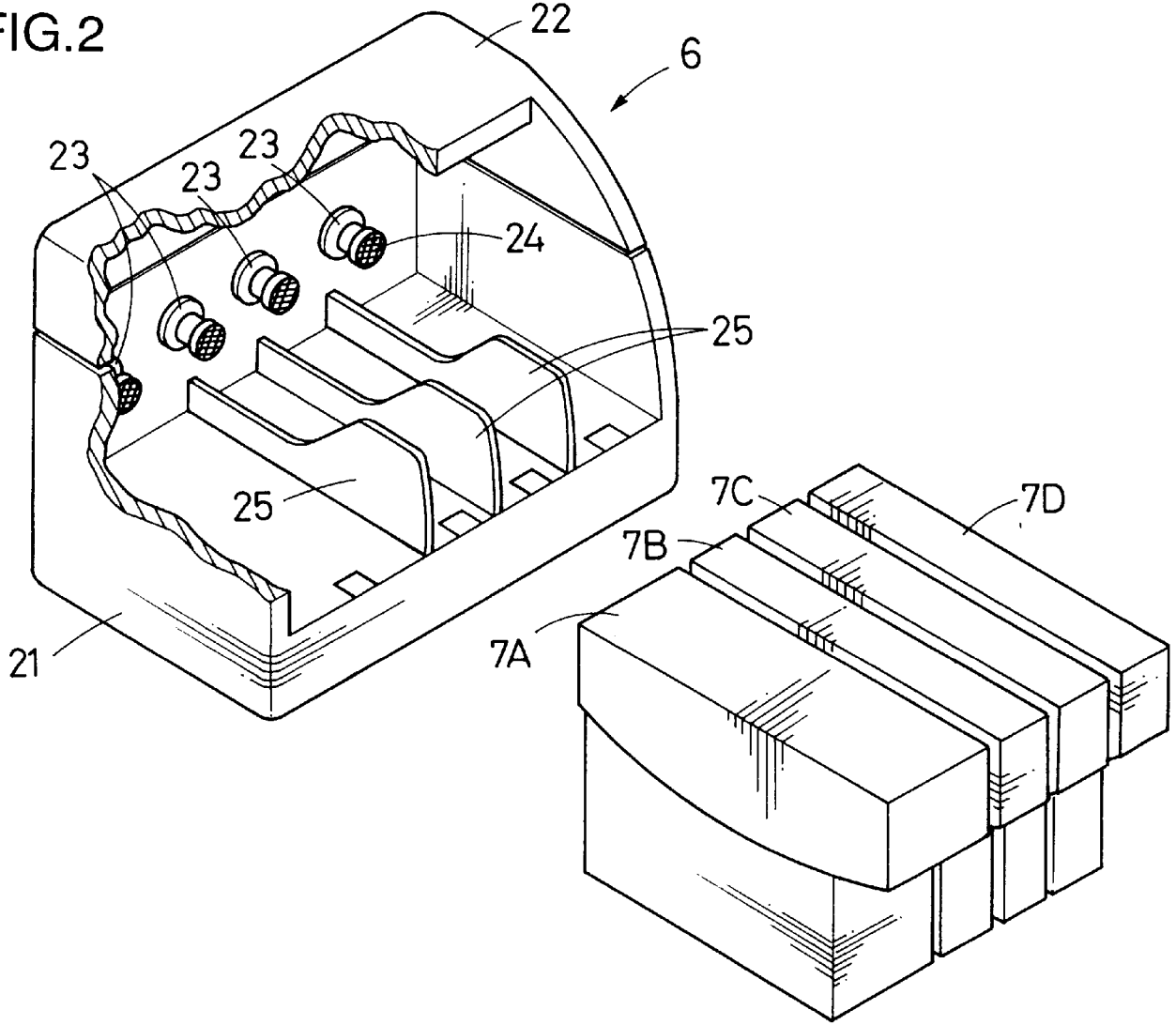
FIG. 2 is a perspective view of a head unit installed in the ink jet printer.

Further, in FIG. 2, the print head 5 in the head unit 6 has head chips (not shown), in which nozzles are formed so as to be able to independently eject ink with four colors. The head chips are stood side by side on a horizontal line in the print head 5. Each head chip has a circuit plate with a piezoelectric ceramic element to produce ink ejecting energy, and when the circuit plate is deformed by electric control of the piezoelectric ceramic element, volume of a channel as an ink path changes, thereby each color ink supplied from the ink cartridges 7A–7D is ejected from each nozzle.

The head unit 6 includes a holder 21 and a cap 22. At the front face of the holder 21, a plurality of head chips mainly constructing the print head 5 are arranged, and ink introduction parts 23 of the head chips are formed so as to penetrate the front wall of the holder 21. At an open end of the ink supply path in the ink introduction part 23, it is attached a filter 24 for removing foreign substance such as dust therefrom. In the holder 21, when each of the ink cartridges 7A–7D with four colors is set to each space partitioned by a rib 25, each ink supply hole of the ink cartridge 7A–7D is connected to the ink introduction part 23, thus ink is supplied to each head chip.

Figure 3:
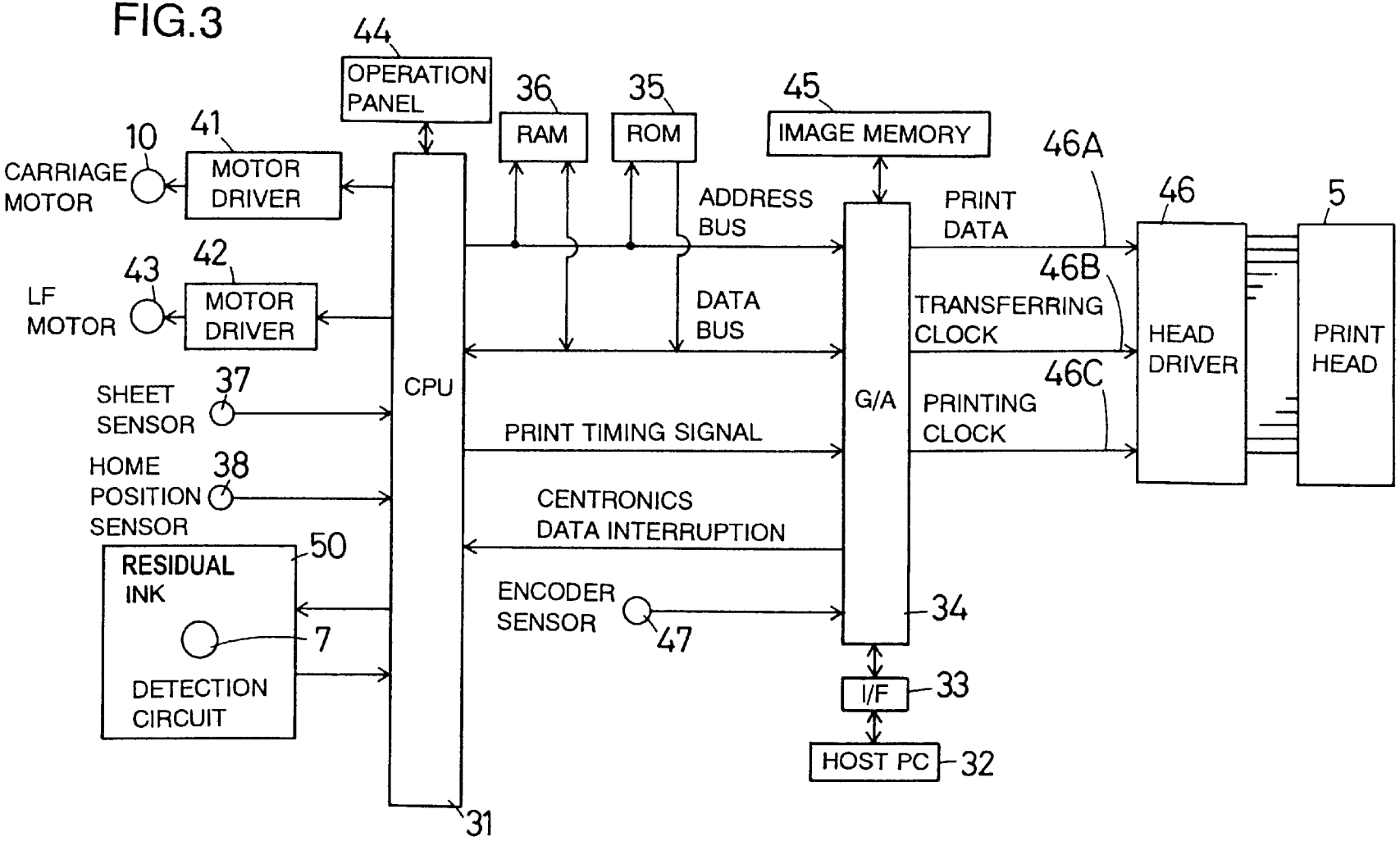
FIG. 3 is a block diagram of control system in the ink jet printer.

The control system of the printer 1 will described with reference to FIG. 3. In FIG. 3, there are provided in the printer 1 CPU 31 (detection means) for controlling each part of the printer 1 and gate array 34 (abbreviated as "G/A circuit" hereinafter) which receives print data through an interface 33 from a host computer 32 and controls developing of the print data. ROM 35 for storing working programs and RAM 36 for temporarily storing the print data are connected between the CPU 31 and the G/A circuit 34, and data transmission is conducted therebetween.

Further, to the CPU 31, a sheet (paper) sensor 37 for detecting whether the print sheet P exists or not, a home position sensor 38 for detecting that the print head 5 positions at a home position and a residual ink detection circuit 50 for detecting residual ink quantity in the ink cartridge 7 are connected. The detection circuit 50 corresponds to pulse oscillation (production) means. The CPU 31 functions as detection means for detecting the residual ink quantity in the ink cartridge 7 in cooperation with the detection circuit 50. The detection circuit 50 will be described in detail hereinafter.

Further, to the CPU 31, the first motor driver 41 for driving the carriage motor 10, the second motor driver 42 for driving the LF motor 43 and the operation panel 44 for inputting various signals to the CPU 31 and displaying a message (mentioned later) are connected, respectively. An image memory 45, which temporarily stores the print data received from the host computer 32 as the image data, is connected to the G/A circuit 34. The head driver 46 operates based on the print data 46A output from the G/A circuit 34, the transferring clock 46B and the printing clock 46C, and drives the print head 5. Further, an encoder sensor 47, which measures moving speed of the carriage 8 and determines print timing, is also connected to the G/A circuit 34.

Figure 4:
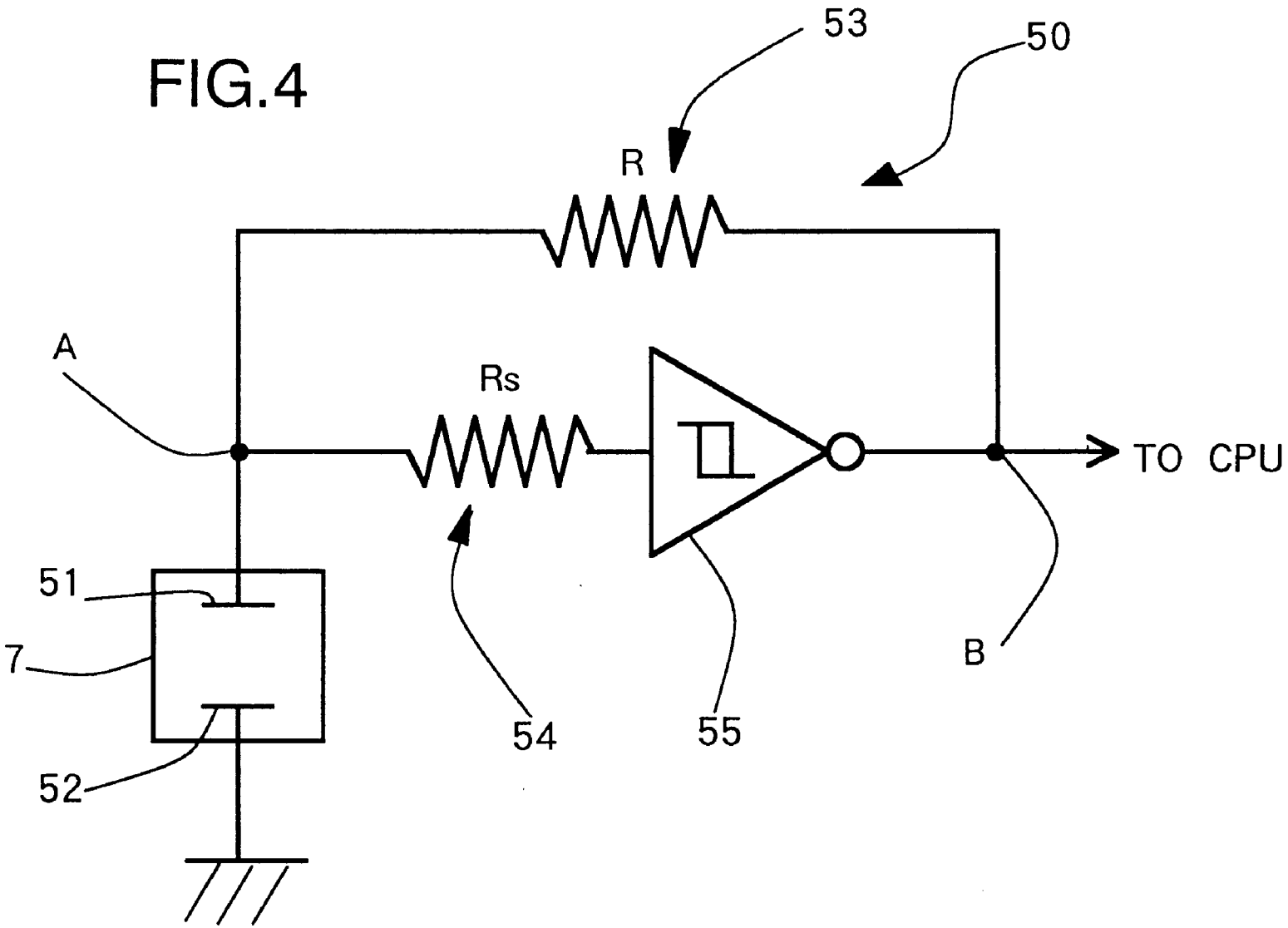
FIG. 4 is a schematic circuit diagram of the detection apparatus according to the first embodiment.
Figure 5:
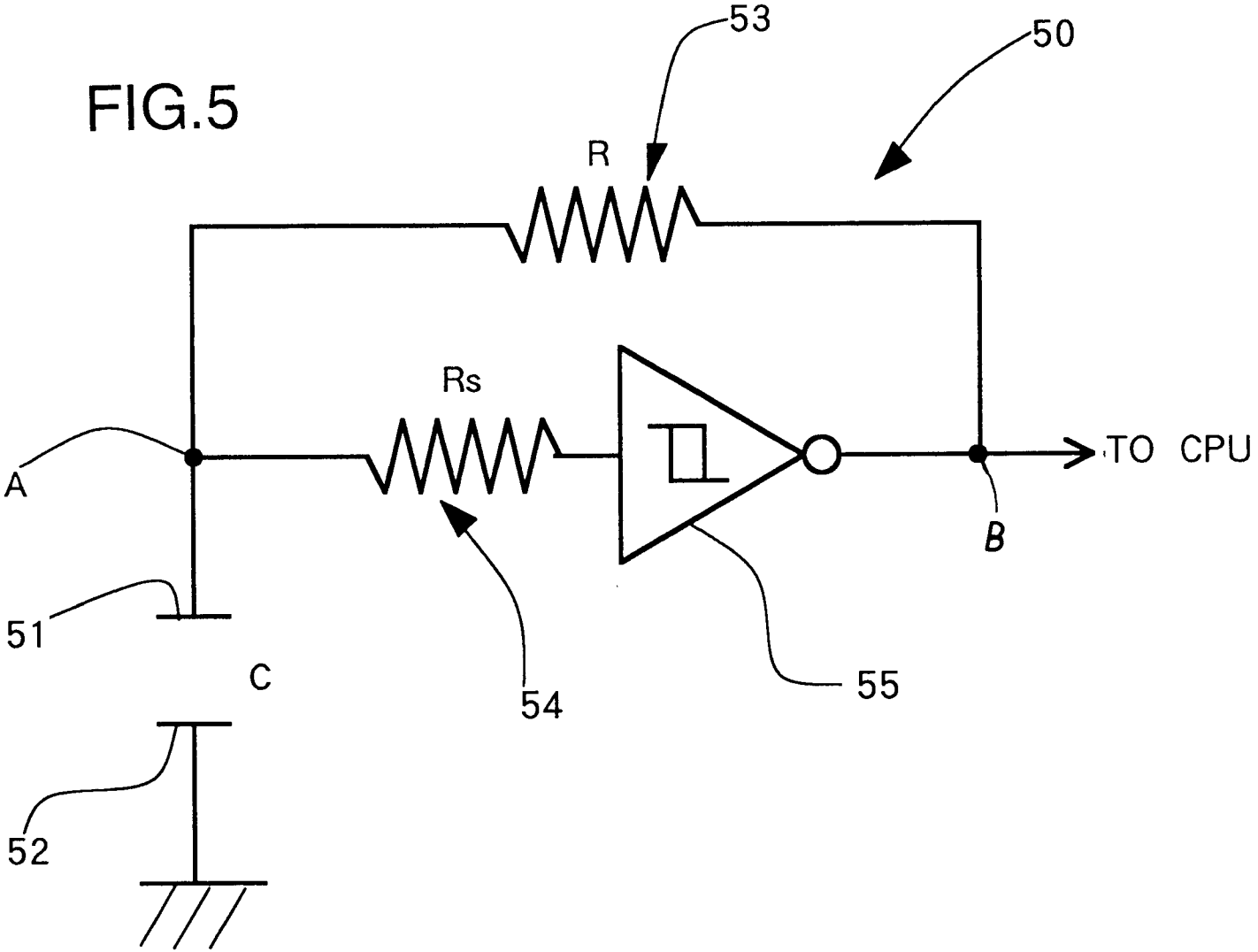
FIG. 5 is an equivalent circuit diagram of the circuit shown in FIG. 4.

Next, the detection circuit 50 of the first embodiment will be described with reference to FIGS. 4, 5. In FIGS. 4, 5, a pair of electrode plates 51, 52 are arranged in the ink cartridge 7, and both the electrode plates 51, 52 construct a condenser C (see FIG. 5) in cooperation with ink filled in the ink cartridge 7. The electrode plate 51 is connected to one end of a timing resistor 53 (shown as "R" in FIGS. 4, 5) which is necessary for residual ink detection, and connected to one end of a current restriction resistor 54 (shown as "Rs" in FIGS. 4, 5) through a junction A. The other end of the current restriction resistor 54 is connected to a logic IC 55. Here, the other electrode plate 52 is grounded and the other end of the timing resistor 53 is connected to an output line of the logic IC 55 at a junction B. The output line of the logic IC 55 is directly connected to the CPU 31, as shown in FIG. 3.

The current restriction resistor 54 is utilized for protecting the logic IC 55 so that excessive current does not flow into the logic IC 55. The logic IC 55 is arranged parallel to the timing resistor 53 in the detection circuit 50. When the signal having a predetermined waveform determined on the basis of the capacitance value of the condenser C and the resistance value of the timing resistor 53 is input to the logic IC 55 through the current restriction resistor 54, the logic IC 55 operates so as to output a rectangular pulse (logic signal) corresponding to the input signal. The logic IC 55, the condenser C and the timing resistor 53 mutually construct so-called CR oscillating circuit. Here, the logic IC 55 has hysteresis function. Such hysteresis function of the logic IC 55 is well-known, thus its explanation will be omitted.

Operation of the above constructed detection circuit 50 will be described with reference to FIG. 6. In the detection circuit 50, the condenser C and the timing resistor 53 construct a so-called CR time constant circuit, thus the signal input to the logic IC 55 through the current restriction resistor 54 from the junction A concludes, as mentioned, to have the waveform determined on the basis of the capacitance value of the condenser C and the resistance value of the timing resistor 53. For example, in case that enough ink is filled in the ink cartridge 7 and the capacitance value of the condenser C becomes large, the waveform of the signal input to the logic IC 55 has a rounded waveform (see the signal D1 in FIG. 6(A)), and its cycle becomes comparatively long. If the signal with such waveform is input to the logic IC 55, the logic IC 55 outputs a rectangular pulse (see the signal D2 in FIG. 6(A)) for every input waveform in the input signal.

Figures 6A, 6B:
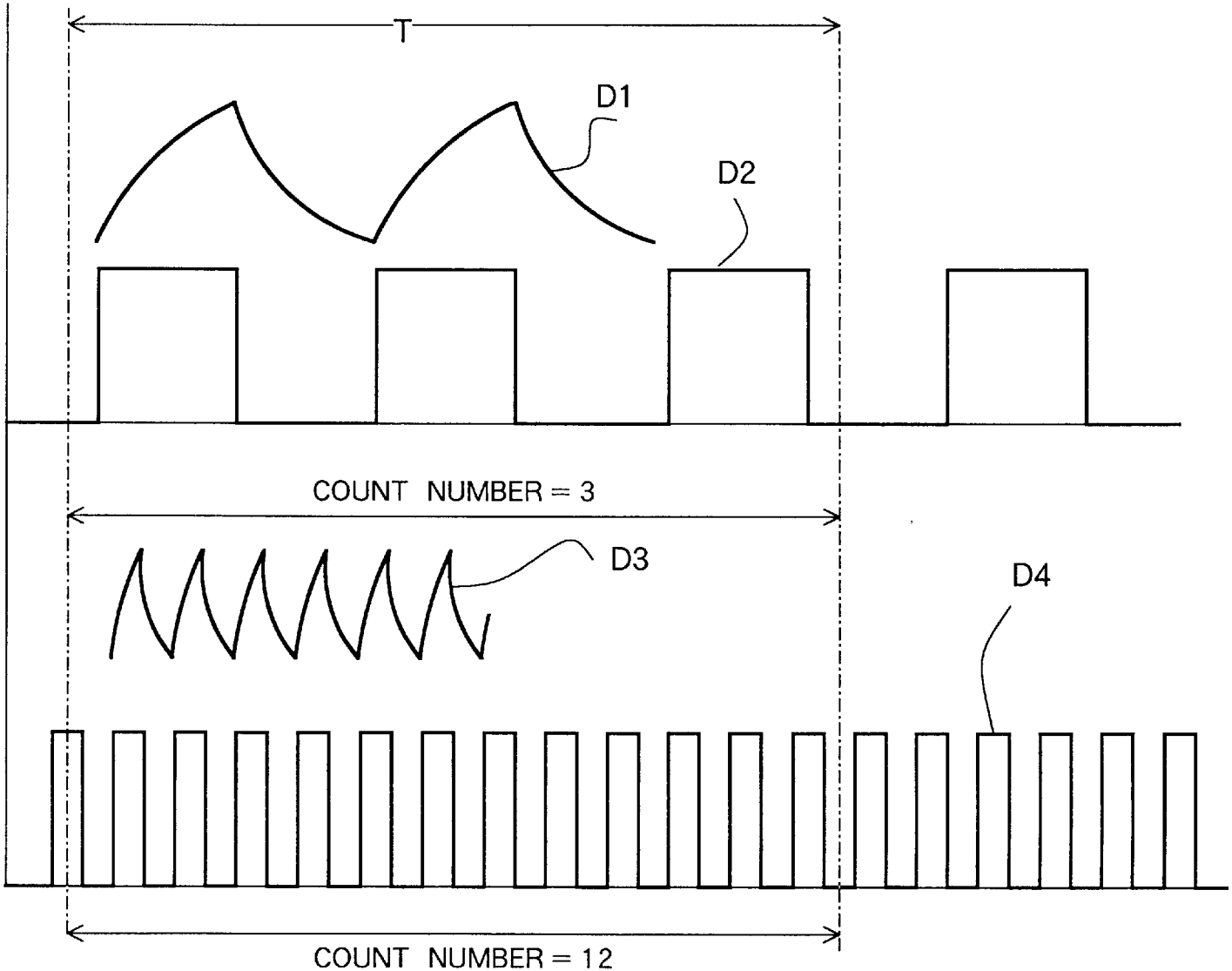
FIGS. 6A and 6B are timing charts indicating a relationship between the input signal input to a logic IC and the output signal when capacitance of the condenser changes corresponding to the residual ink quantity in the ink cartridge in the first embodiment.

On the other hand, in case that the residual ink quantity decreases and the capacitance value of the condenser C becomes small, the waveform of the signal input to the logic IC 55 has a waveform in which its round is reduced, and its cycle becomes short (see the signal D3 in FIG. 6(B)). If the signal with such waveform is input to the logic IC 55, the logic IC 55 outputs the rectangular pulse (see the signal D4 in FIG. 6(B)) for every input waveform in the input signal.

In this way, the logic IC 55 outputs the rectangular pulse signals D2, D4 corresponding to the capacitance value change of the condenser C, that is, the residual ink quantity, while changing oscillation frequency based on the capacitance value and the resistance value of the timing resistor 53. At that time, the oscillation frequency of the rectangular pulse signals D2, D4 output from the logic IC 55 is determined by f=1/CR. Therefore, the output signals D2, D4 can be processed as the output signals from the logic IC 55. As a result, the A/D converter, which is necessary for the conventional detection apparatus, the detection circuit 50 and construction of the interface can be simplified.

Figure 7:
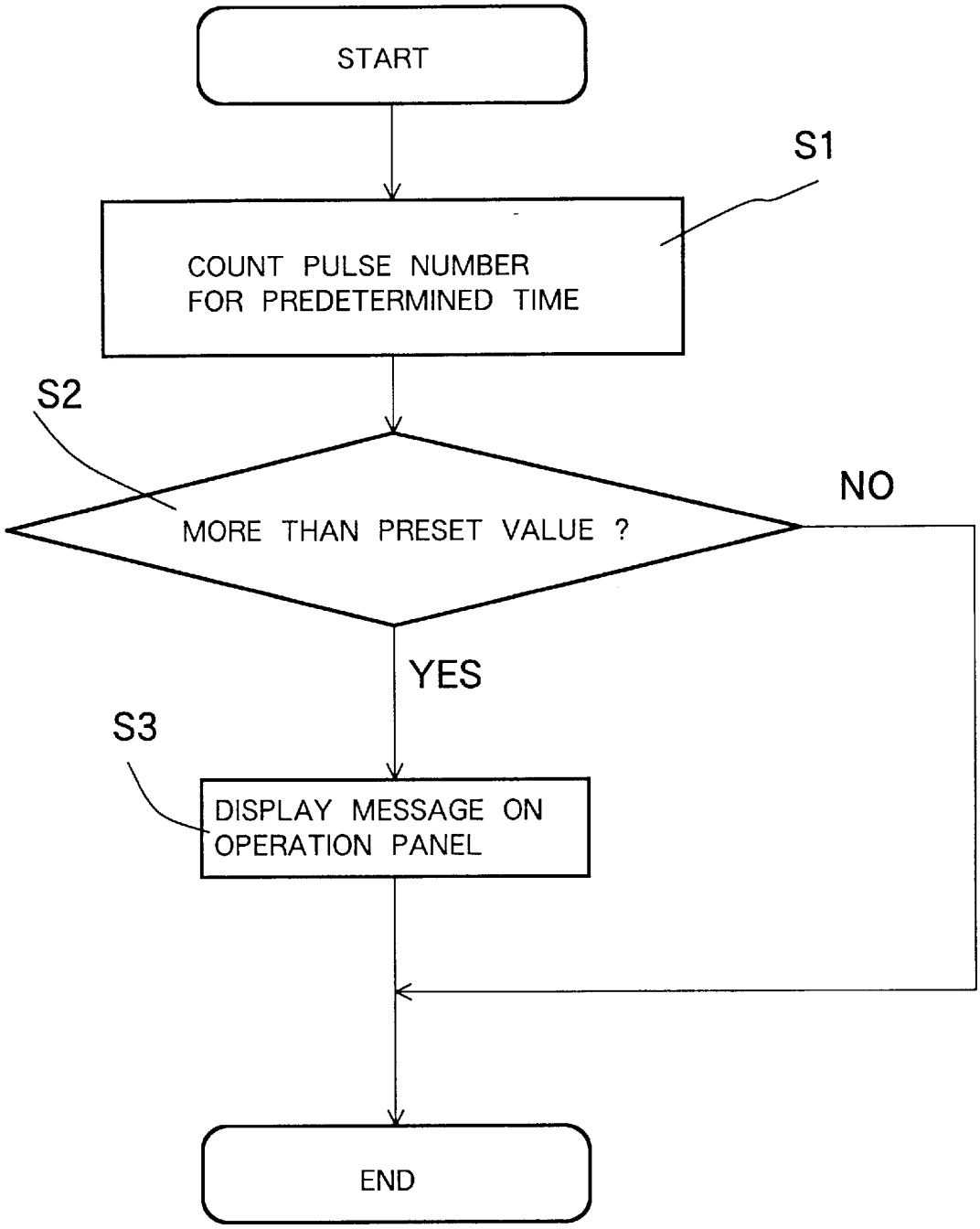
FIG. 7 is a flowchart for detecting the residual ink in the first embodiment.

Operation of the above constructed detection circuit 50 will be described with reference to FIG. 7. After the program for detecting the residual ink quantity starts, it is counted in step (abbreviated as "S" hereinafter) S1 the pulse number of rectangular pulses output from the logic IC 55 for a predetermined time T (see FIG. 6). In S2, it is judged whether the counted pulse number exceeds a preset value. Here, for example, the preset value is set to 10. if the counted pulse number dose not exceed the preset value (S2:NO), program is terminated. On the other hand, if the counted pulse number exceeds the preset value (S2:YES), it is displayed in S3 on the operation panel 44 a message "Ink in ink cartridge runs out." Thereby, such message is informed to a user, thereafter the user exchanges the old ink cartridge 7 with a new one according to the above message. At this time, program is terminated.

Each process will be described in detail with reference to FIGS. 6(A), 6(B). In FIG. 6(A), the rounded signal D1 is input to the logic IC 55 and the rectangular pulse D2 is output from the logic IC 55. At that time, the pulse number of the rectangular pulses counted for the predetermined time T is 3. This number "3" is less than the preset value (10). In this case, judgement in S2 is "NO", thus it concludes that the residual ink quantity in the ink cartridge 7 is enough for printing.

On the contrary, in FIG. 6(B), the signal D3 is input to the logic IC 55 and the rectangular pulse D4 is output from the logic IC 55. At that time, the pulse number of the rectangular pulses counted for the predetermined time T is 12. This number "12" exceeds the preset value (10). In this case, judgement in S2 is "YES", thus it concludes that the residual ink quantity in the ink cartridge 7 decreases and it is the time to exchange the old ink cartridge 7 with a new one. Therefore, the message "Ink in ink cartridge runs out." is displayed on the operation panel 44 and such message is informed to the user.

As mentioned above, in the detection circuit 50 of the first embodiment, the CR oscillating circuit is constructed from the condenser C in which the capacitance value changes according to the residual ink quantity and the logic IC 55, and the pulse signal with frequency changes corresponding to the residual ink quantity is oscillated by the logic IC 55, and further the residual ink quantity is detected by counting the pulse number of the pulse signal for the predetermined time T on the basis of the frequency of the pulse signals output from the logic IC 55.

Therefore, digital processing can be conducted by directly using the logic signals output from the logic IC 55, without using the A/D converter. Thereby, the detection apparatus for detecting the residual ink quantity in the ink cartridge 7 can be simply constructed, and the apparatus can be realized with low cost and compact size. Further, since a CR oscillating circuit is used, it concludes that an alternating waveform is applied to ink in the ink cartridge 7, thus it can prevent ink from occurring electrolysis therein and decomposition thereof.

The logic IC 55 is a self-oscillating circuit, thus the logic IC 55 can oscillate by applying electric power to the detection circuit 50, without an oscillator outputting an alternating signal or a switching circuit. Therefore, control thereof can be simplified and the detection mechanism can be miniaturized.

Further, the pulse oscillating circuit in the detection circuit 50 is constructed from the electrode plates 51, 52 arranged in the ink cartridge 7, the timing resistor 53 and the logic IC 55, thus circuit construction can be miniaturized and can be realized without particularly changing the control circuit of the ink jet printer. Since highly efficient elements and circuit are not used in the detection circuit 50, such circuit 50 can be installed in the control device of the ink jet printer.

If the pulse number of the pulse signals output from the logic IC 55 exceeds the preset value and the residual ink quantity runs out, the message is displayed on the operation panel 44 and informed to the user, thus maintenance such as exchange of the ink cartridge 7 can be rapidly done.

Next, the detection circuit of the second embodiment will be described with reference to FIGS. 8, 9. Here, the detection circuit of the second embodiment has basically the same construction as the detection circuit 50 in the first embodiment.

The second embodiment is different from the first embodiment at the following point. That is, in the detection circuit of the second embodiment, there are arranged in the ink cartridge a pair of electrode plates operating as a resistor in which resistance value changes corresponding to the residual ink quantity and a timing condenser is connected, and further both the electrode plates and the timing condenser construct CR oscillating circuit in cooperation with the logic IC. Remaining construction is the same as the first embodiment. Therefore, the second embodiment will be described by giving the same numbers to the same elements as in the first embodiment.

Figure 8:
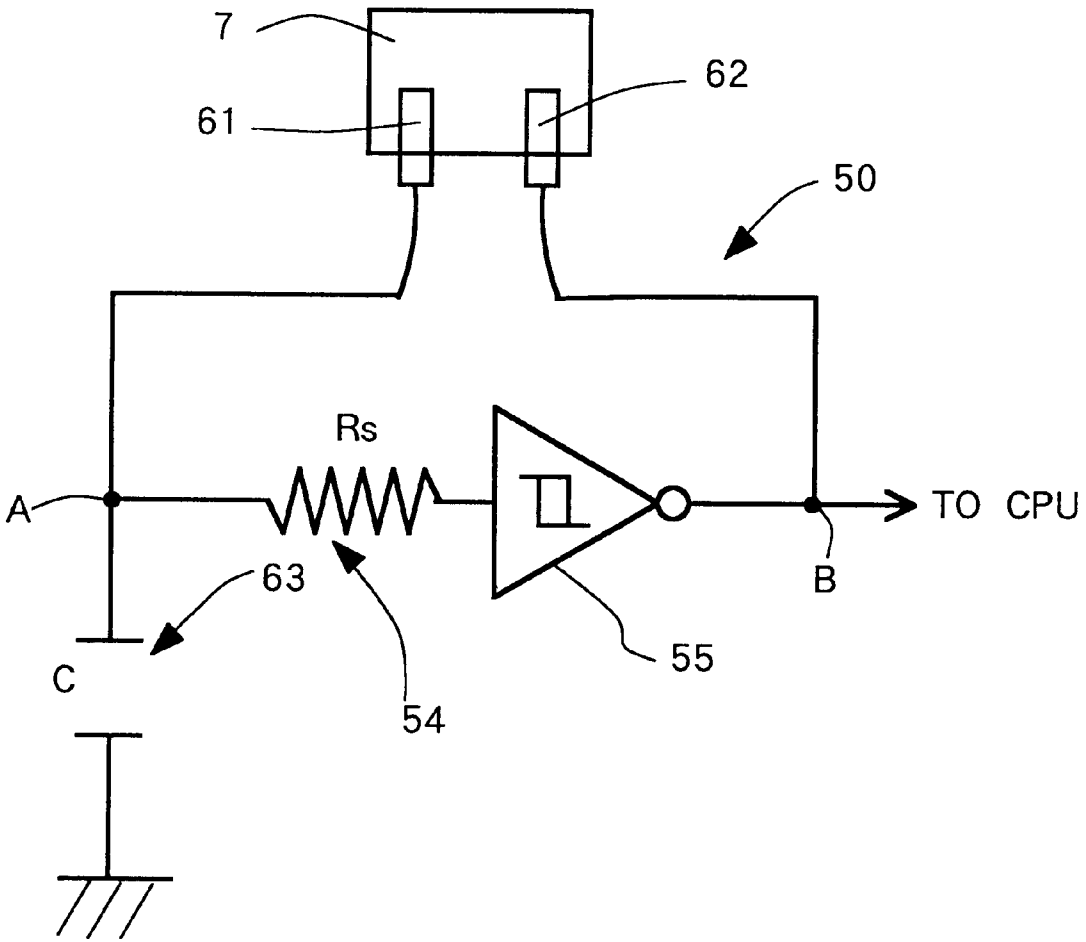
FIG. 8 is a schematic circuit diagram of the detection apparatus according to the second embodiment.
Figure 9:
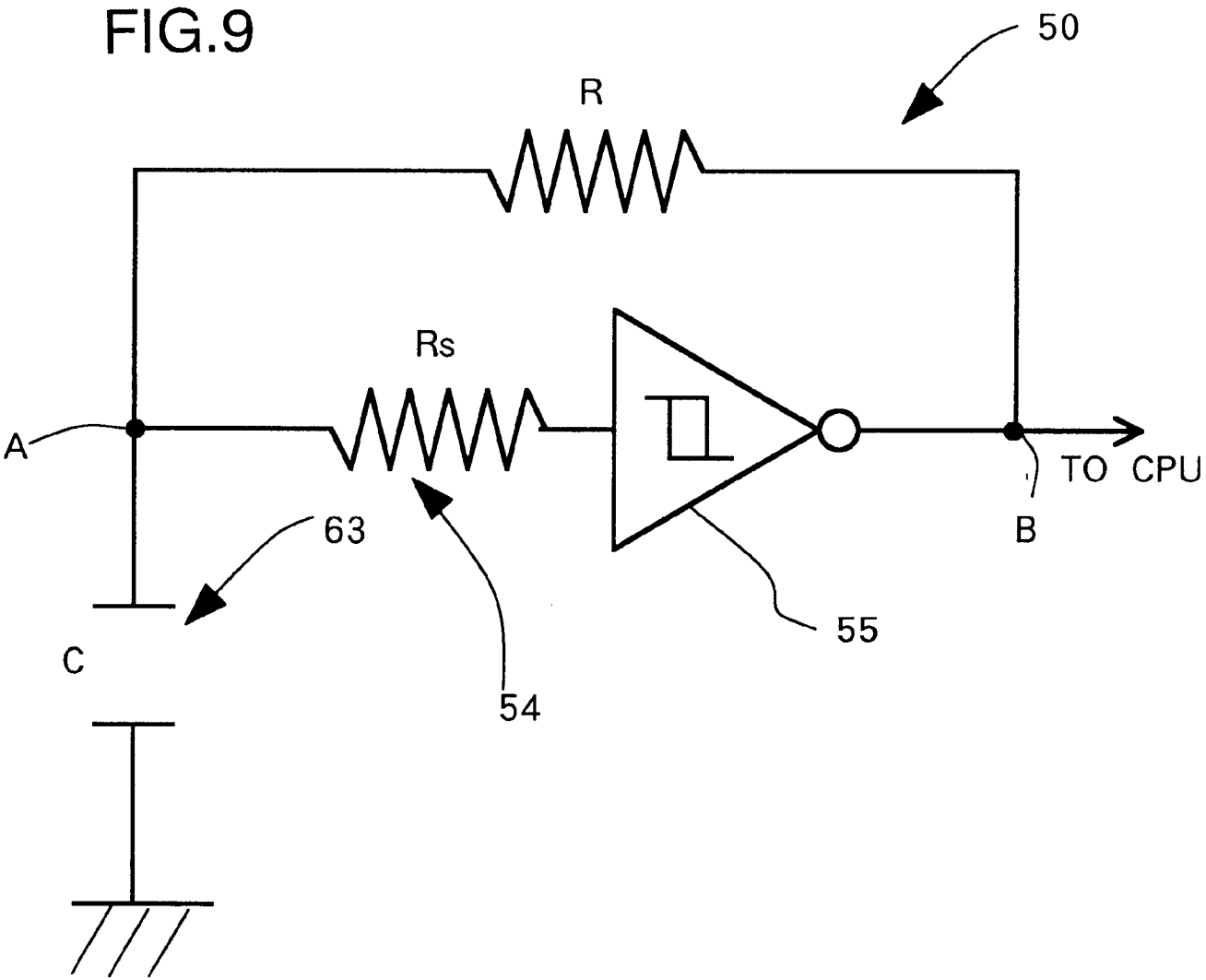
FIG. 9 is an equivalent circuit diagram of the circuit shown in FIG. 8.

In FIGS. 8, 9, a pair of electrode plates 61, 62 are arranged in the ink cartridge 7, and both the electrode plates 61, 62 construct a resistor R (see FIG. 9) in cooperation with ink filled in the ink cartridge 7. The electrode plate 61 is connected to one end of a timing condenser 63 (shown as "C" in FIG. 9) which has a predetermined capacitance value, and connected to one end of a current restriction resistor 54 (shown as "Rs" in FIGS. 8, 9) through a junction A. The other end of the current restriction resistor 54 is connected to a logic IC 55. The other electrode plate 62 is connected to an output line of the logic IC 55 at a junction B. Here, the other end of the timing condenser 63 is grounded and the output line of the logic IC 55 is directly connected to the CPU 31, as shown in FIG. 3.

The current restriction resistor 54 is utilized for protecting the logic IC 55 so that excessive current does not flow into the logic IC 55. The logic IC 55 is arranged parallel to the resistor R constructed from the electrode plates 61, 62 and ink. When the signal having a predetermined waveform determined on the basis of the capacitance value of the timing condenser 63 and the resistance value of the resistor R is input to the logic IC 55 through the current restriction resistor 54, the logic IC 55 operates so as to output a rectangular pulse (logic signal) corresponding to the input signal. The logic IC 55, the timing condenser 63 and the resistor R mutually construct a so-called CR oscillating circuit. Here, the logic IC 55 has hysteresis function. Such hysteresis function of the logic IC 55 is well-known, thus its explanation will be omitted.

Operation of the above constructed detection circuit 50 will be described with reference to FIG. 10. In the detection circuit 50, the timing condenser 63 and the resistor R construct a so-called CR time constant circuit, thus the signal input to the logic IC 55 through the current restriction resistor 54 from the junction A concludes, as mentioned, to have the waveform determined on the basis of the capacitance value of the timing condenser 63 and the resistance value of the resistor R. For example, in case that enough ink is filled in the ink cartridge 7 and the resistance value of the resistor R becomes small, the waveform of the signal input to the logic IC 55 has a slightly rounded waveform (see the signal D5 in FIG. 10(A)), and its cycle becomes comparatively short. If the signal with such waveform is input to the logic IC 55, the logic IC 55 outputs the rectangular pulse (see the signal D6 in FIG. 10(A)) for every input waveform in the input signal.

Figures 10A, 10B:
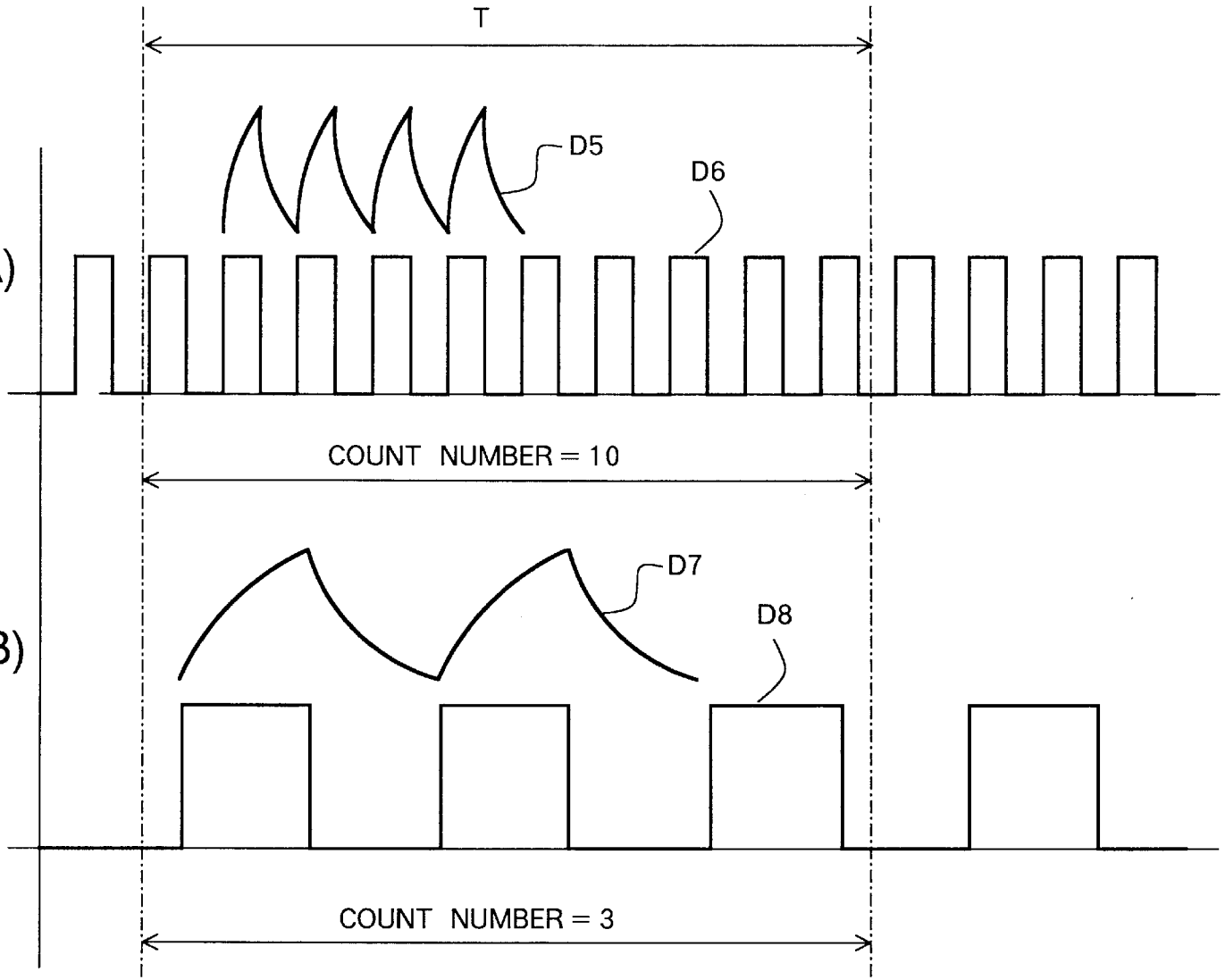
FIGS. 10A and 10B are timing charts indicating a relationship between the input signal input to a logic IC and the output signal when resistance of the resistor changes corresponding to the residual ink quantity in the ink cartridge in the second embodiment.

On the other hand, in case that the residual ink quantity decreases and the resistance value of the resistor R becomes large, the waveform of the signal input to the logic IC 55 has a waveform in which its round is increased, and its cycle becomes long (see the signal D7 in FIG. 10(B)). If the signal with such waveform is input to the logic IC 55, the logic IC 55 outputs the rectangular pulse (see the signal D8 in FIG. 10(B)) for every input waveform in to the input signal.

In this way, the logic IC 55 outputs the rectangular pulse signals D6, D8 corresponding to the resistance value change of the resistor R, that is, the residual ink quantity, while changing oscillation frequency based on the resistance value and the capacitance value of the timing condenser 63. At that time, the oscillation frequency of the rectangular pulse signals D6, D8 output from the logic IC 55 is determined by f=1/CR. Therefore, the output signals D6, D8 can be processed as the output signals from the logic IC 55. As a result, the A/D converter, which is necessary for the conventional detection apparatus, does not need for the detection circuit 50 and construction of the interface can be simplified.

Figure 11:
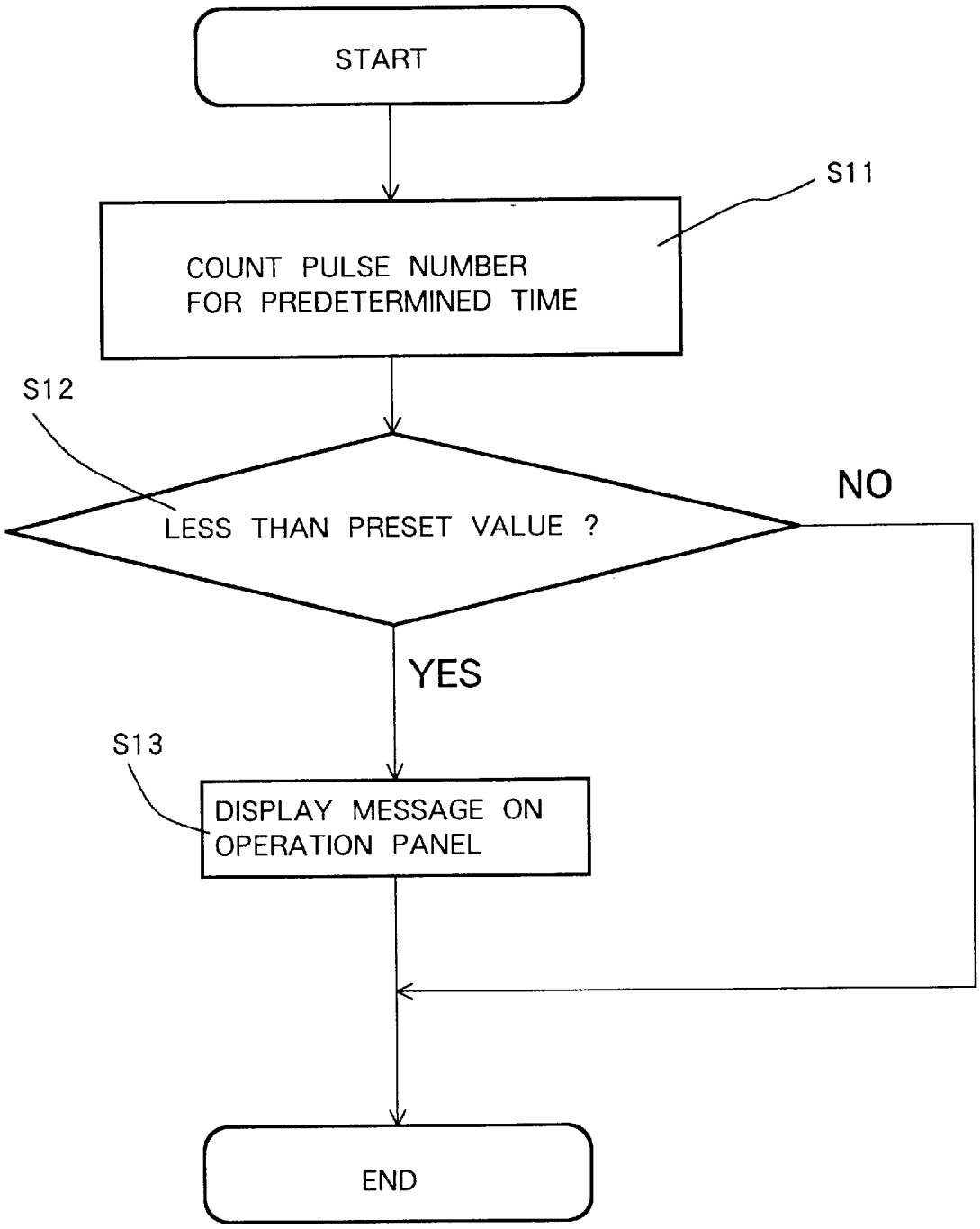
FIG. 11 is a flowchart for detecting the residual ink in the second embodiment.

Operation of the above constructed detection circuit 50 will be described with reference to FIG. 11. After the program for detecting the residual ink quantity starts, it is counted in S11 the pulse number of rectangular pulses output from the logic IC 55 for a predetermined time T (see FIG. 10). In S12, it is judged whether the counted pulse number is less than a preset value. Here, for example, the preset value is set to 5. if the counted pulse number is not less than the preset value (S12:NO), program is terminated. On the other hand, if the counted pulse number is less than the present value (S12:YES), it is displayed in S13 on the operation panel 44 a message "Ink in ink cartridge runs out." Thereby, such message is informed to the user, thereafter the user exchanges the old ink cartridge 7 with a new one according to the above message. At this time, program is terminated.

Each process will be described in detail with reference to FIG. 10. In FIG. 10(A), the signal D5 is input to the logic IC 55 and the rectangular pulse D6 is output from the logic IC 55. At that time, the pulse number of the rectangular pulses counted for the predetermined time T is 10. This number "10" is more than the preset value (5). In this case, judgement in S12 is "NO", thus it concludes that the residual ink quantity in the ink cartridge 7 is enough for printing.

On the contrary, in FIG. 10(B), the signal D7 is input to the logic IC 55 and the rectangular pulse D8 is output from the logic IC 55. At that time, the pulse number of the rectangular pulses counted for the predetermined time T is 3. This number "3" is less than the preset value (5). In this case, judgement in S12 is "YES", thus it concludes that the residual ink quantity in the ink cartridge 7 decreases and it is the time to exchange the old ink cartridge 7 with a new one. Therefore, the message "Ink in ink cartridge runs out." is displayed on the operation panel 44 and such message is informed to the user.

As mentioned above, in the detection circuit 50 of the second embodiment, the CR oscillating circuit is having the resistor R constructed from the electrode plates 61, 62 in which the resistance value changes according to the residual ink quantity and the logic IC 55, and the pulse signal with frequency changing corresponding to the residual ink quantity is oscillated by the logic IC 55, and further the residual ink quantity is detected by counting the pulse number of the pulse signal for the predetermined time T on the basis of the frequency of the pulse signal output from the logic IC 55.

Therefore, digital processing can be conducted by directly using the logic signals output from the logic IC 55, without using the A/D converter. Thereby, the detection apparatus for detecting the residual ink quantity in the ink cartridge 7 can be simply constructed, and the apparatus can be realized with low cost and compact size. Further, since a CR oscillating circuit is used, it concludes that an alternating waveform is applied to ink in the ink cartridge 7, thus it can prevent ink from occurring electrolysis therein and decomposition thereof.

As in the first embodiment, the logic IC 55 is a self-oscillating circuit, thus the logic IC 55 can oscillate by applying electric power to the detection circuit 50, without an oscillator outputting an alternating signal or a switching circuit. Therefore, control thereof can be simplified and the detection mechanism can be miniaturized.

Further, the pulse oscillating circuit in the detection circuit 50 is constructed from the resistor R having the electrode plates 61, 62 arranged in the ink cartridge 7, the timing condenser 63 and the logic IC 55, thus circuit construction can be miniaturized and can be realized without particularly changing the control circuit of the ink jet printer. Since highly efficient elements and circuit are not used in the detection circuit 50, such circuit 50 can be installed in the control device of the ink jet printer.

If the pulse number of the pulse signal output from the logic IC 55 becomes less than the preset value and the residual ink quantity runs out, the message is displayed on the operation panel 44 and informed to the user, thus maintenance such as exchange of the ink cartridge 7 can be rapidly done.

Figure 12:
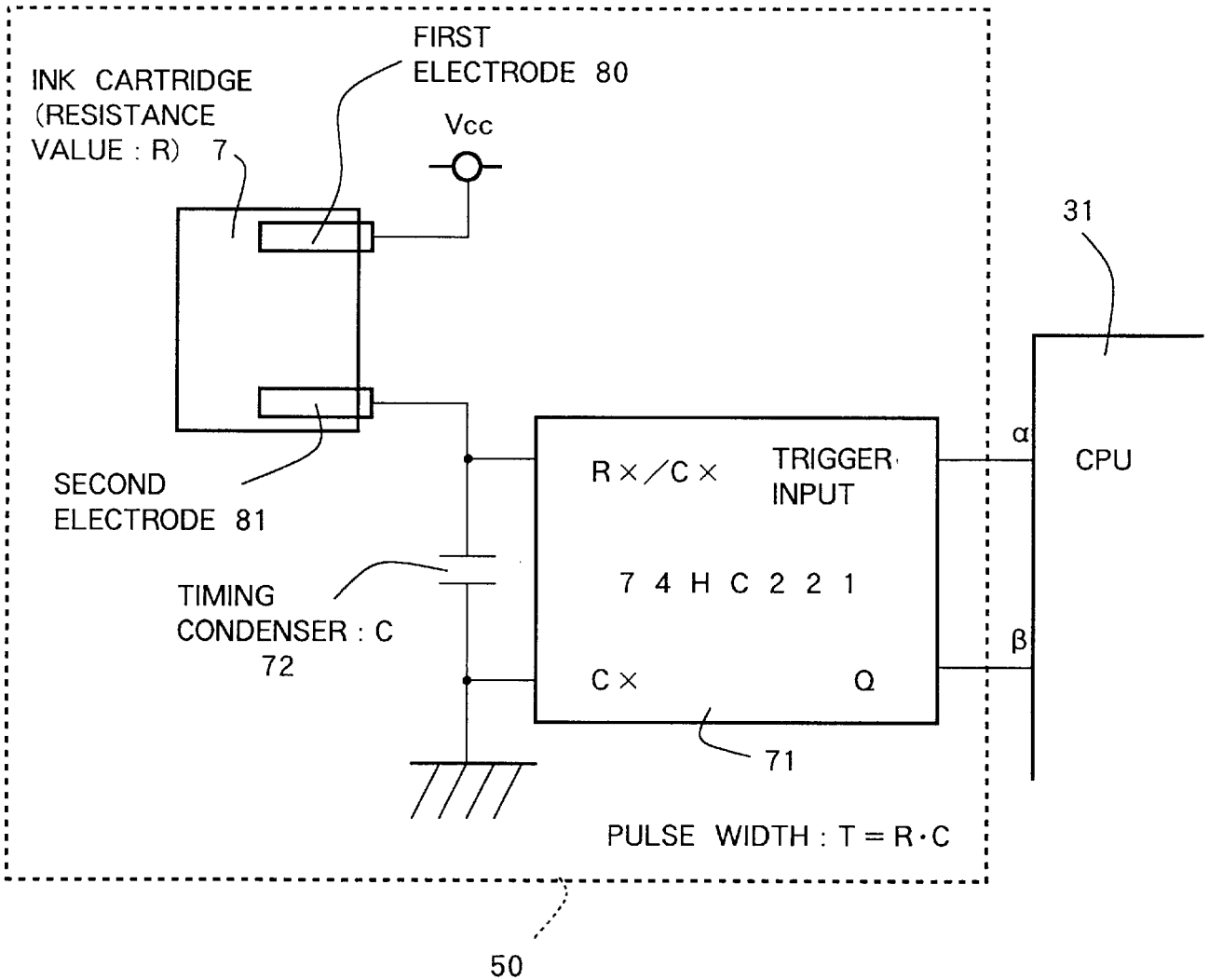
FIG. 12 is a schematic circuit diagram of the detection apparatus according to the third embodiment.
Figures 13A, 13B:
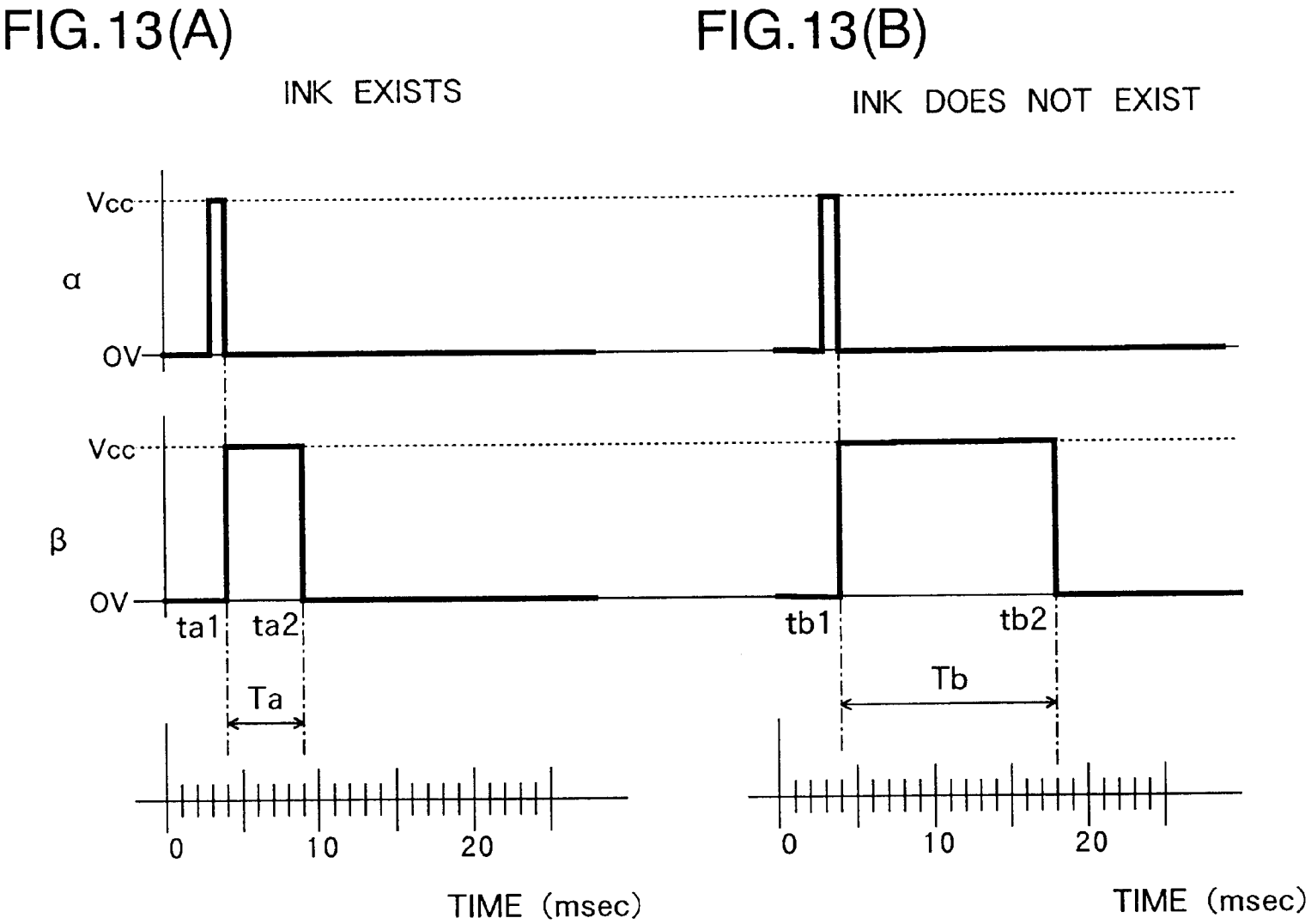
FIGS. 13A and 13B are timing charts indicating a relationship between the input signal input to a logic IC and the output signal when resistance of the resistor changes corresponding to the residual ink quantity in the ink cartridge in the third embodiment.

Next, the detection circuit 50 of the third embodiment will be described with reference to FIG. 12, FIGS. 13(A) and 13(B). FIG. 12 shows a circuit diagram of the detection circuit 50, FIGS. 13(A), 13(B) shows a timing chart of input and output signals in the detection circuit 50. In FIG. 12, FIGS. 13(A), 13(B), "α" indicates a measuring signal input from the CPU 31 as detection means, and "β" indicates a pulse signal input to the CPU 31, the pulse signal having a waveform on the basis of resistance value (R) of the resistor which changes corresponding to the residual ink quantity in the ink cartridge and capacitance value (C) of the timing condenser 72.

In the detection circuit 50 of the third embodiment, a multivibrator circuit is constructed from the resistor representing equivalently to resistance of the ink cartridge 7, the timing condenser 72 and the logic IC 71. In the ink cartridge 7, the first electrode 80 and the second electrode 81 are arranged, and resistance the value between the first and second electrodes 80, 81 changes according to the residual ink quantity. Corresponding to the change of the resistance value, the detection circuit 50 outputs the detection signal β with rectangular waveform based on the input signal α.

In the logic IC 71, when a resistor and a condenser are connected to the Rx/Cx terminal and Cx terminal, the logic IC 71 function to continue a monostable mode for a predetermined time set by the resistor and condenser. This function of the logic IC 71 is well-known, thus its explanation will be omitted.

Operation of the detection circuit 50 will be described with reference to FIGS. 13(A), 13(B). In the detection circuit 50, when the measuring signal α with rectangular waveform is input, the logic IC 71 outputs the detection signal β at the trailing edge (ta1, tb1) of the signal α. Here, the waveform of the detection signal β is determined on the basis of the resistance value (R) of the resistor including the electrodes 80, 81 and the capacitance value (C) of the timing condenser 72. For example, in case that enough ink is filled in the ink cartridge 7 and the resistance value (R) of the resistor becomes small, the pulse width of the detection signal β output from the logic IC 71 is determined on the basis of the resistance value (R1) of the resistor and capacitance value (C) of the timing condenser 72, and becomes Ta (see FIG. 13(A)).

On the other hand, in case that the residual ink quantity decreases and the resistance value (R) of the resistor becomes large, the pulse width of the detection signal β output from the logic IC 71 is determined on the basis of the resistance value (R2) of the resistor and capacitance value (C) of the timing condenser 72, and becomes Ta (see FIG. 13(B)). Here, since the resistance value (R2) of the resistor is larger than the resistance value (R1), the pulse width Tb is wider than the pulse width Ta.

In this way, the pulse width of the detection signal β changes on the basis of the resistance value (R) of the resistor and the capacitance value (C) of the timing condenser 72, corresponding to the change of the resistance value (R) in the resistor, that is, the residual ink quantity. At that time, the pulse width PW is determined by PW=CR. Therefore, the detection signal β can become the logic signal. As a result, the A/D converter, which is necessary for the conventional detection apparatus, the detection circuit 50 and construction of the interface can be simplified.

Figure 14:
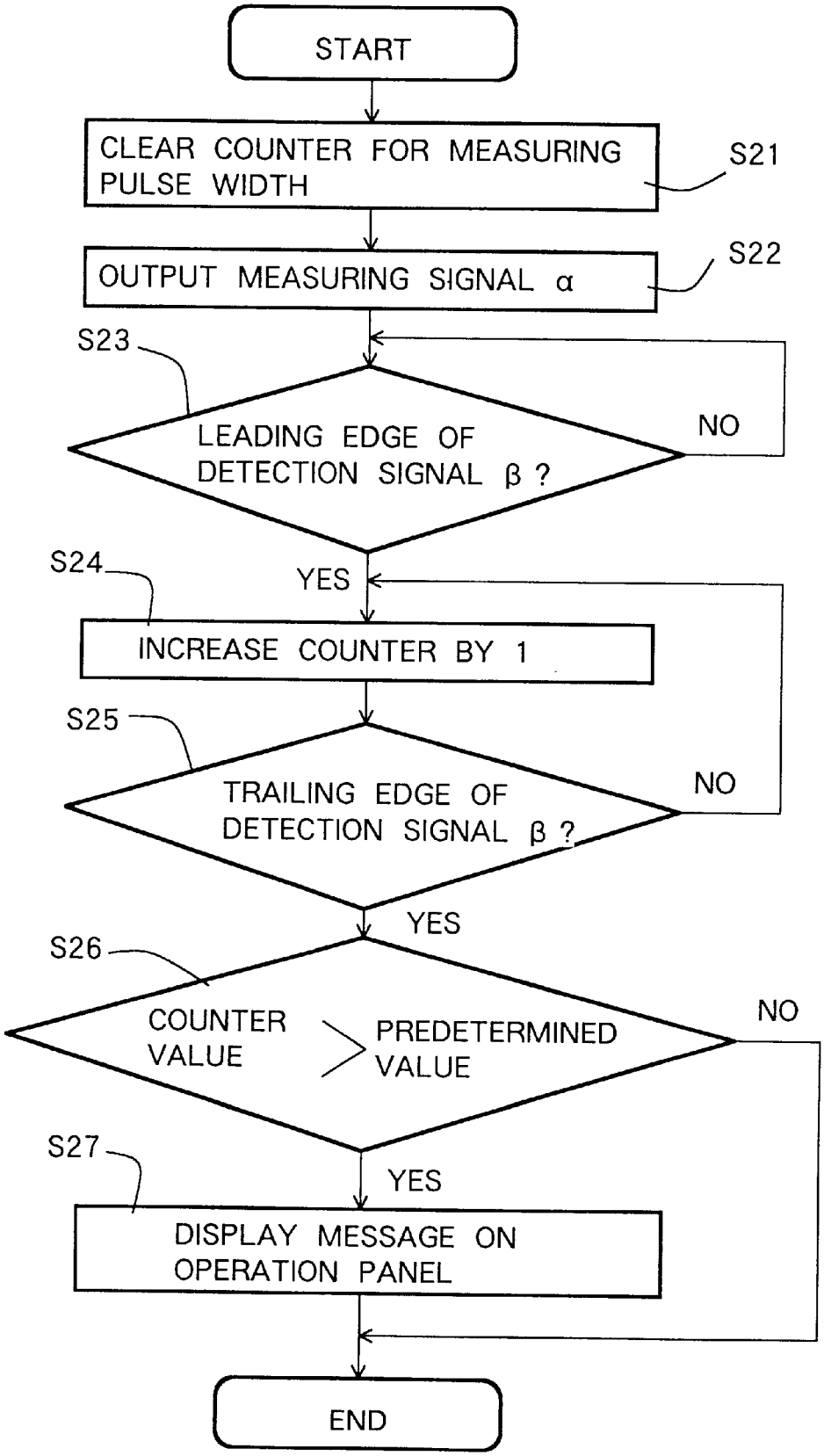
FIG. 14 is a flowchart for detecting the residual ink in the third embodiment.

Operation of the above constructed detection circuit in the third embodiment will be described with reference to FIG. 14. In the operation, the CPU 31 judges whether the residual ink in the ink cartridge 7 is enough or not based on the detection signal β.

First, a counter formed in the RAM 36 is cleared in S21 by the CPU 31. In S22, the measuring signal α with rectangular pulse waveform is produced (see FIG. 13(A), the waveform of signal α, Ta1), then the CPU 31 waits until the leading edge of the signal β is detected (S23:NO). When the leading edge of the signal β is detected (S23:YES), the counter is increased by 1 (S24) and the CPU 31 waits until the trailing edge of the signal β is detected (S25:NO). Further, if the trailing edge of the signal β is detected (S25:YES), the counter value of the counter is compared with a predetermined value stored in the ROM 35 (S26). Here, for example, the predetermined value is set to 10,000. If the counter value of the counter is not more than the predetermined value (S26:NO), program is terminated. On the other hand, if the counter value is more than the predetermined value (S26:YES), it is displayed on the operation panel 44 a message S27 "Ink in ink cartridge runs out.", and such message is informed to the user. The user can exchange the old ink cartridge 7 with a new one.

Operation of the detection circuit 50 will be described in detail with reference to FIG. 13. First, a case will be described in which the CPU 31 judges that the residual ink quantity the ink cartridge 7 is enough. In FIG. 13(A), the measuring signal α is input (Ta1), and the detection signal β rises up based on the trailing edge of the signal α. After the logic IC 71 is retained under monostable state for a time determined by the resistance value (R1) and the capacitance value (C), the detection signal β trails (Ta2). At that time, the pulse width of the detection signal β is Ta which is 4 milli seconds (msec). If the time necessary for conducting processes in S24, S25 is 1 micro second, the counter value of the counter becomes 4,000. Therefore, since the counter value is smaller than the predetermined value (10,000), judgement in S26 becomes "NO" and the residual ink in the ink cartridge 7 is enough for printing.

Next, it will be described a case that the CPU 31 judges that the residual ink quantity in the ink cartridge 7 runs out. In FIG. 13(B), the measuring signal α is input (Tb1), and the detection signal β rises up based on the trailing edge of the signal α. After the logic IC 71 is retained under monostable state for a time determined by the resistance value (R2) and the capacitance value (C), the detection signal β trails (Tb2). At that time, the pulse width of the detection signal β is Tb which is 14 milli seconds (msec). If the time necessary for conducting processes in S24, S25 is 1 micro second, the counter value of the counter becomes 14,000. Therefore, since the counter value is larger than the predetermined value (10,000), judgement in S26 becomes "YES". Thus, it concludes that the residual ink quantity in the ink cartridge 7 decreases and it is the time to exchange the old ink cartridge 7 with a new one. Therefore, the message "Ink in ink cartridge runs out." is displayed on the operation panel 44 and such message is informed to the user.

As mentioned above, in the detection circuit 50 of the third embodiment, the detection signal β with the pulse width which changes corresponding to the residual ink quantity can be obtained by the multivibrator circuit constructed from the resistor in which the resistance value changes according to residual ink quantity, the timing condenser 72 and the logic IC 71. Further, the residual ink quantity is detected by measuring the pulse width of the detection signal β output from the multivibrator circuit.

Therefore, digital processing can be conducted by directly using the logic signals output from the logic IC 71, without using the A/D converter. Thereby, the detection apparatus for detecting the residual ink quantity in the ink cartridge 7 can be simply constructed, and the apparatus can be realized with low cost and compact size.

Further, the multivibrator circuit in the detection circuit 50 is constructed from the electrodes 80, 81 arranged in the ink cartridge 7, the timing condenser 72 and logic IC 71. Thus, circuit construction can be miniaturized and can be realized without particularly changing the control circuit of the ink jet printer. Since highly efficient elements and circuit are not used in the detection circuit 50, such circuit 50 can be installed in the control device of the ink jet printer.

Figure 15:
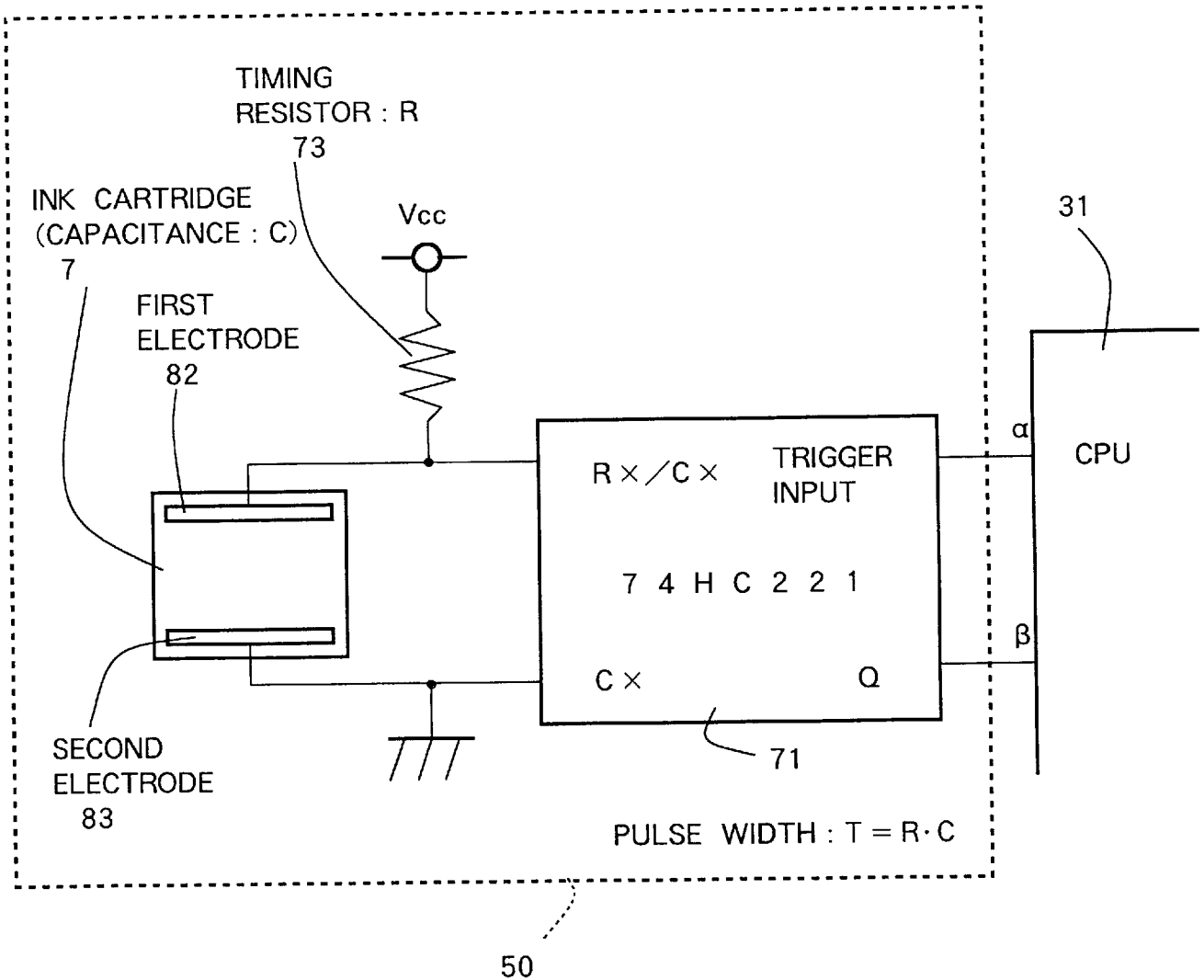
FIG. 15 is a schematic circuit diagram of the detection apparatus according to the fourth embodiment.
Figures 16A, 16B:
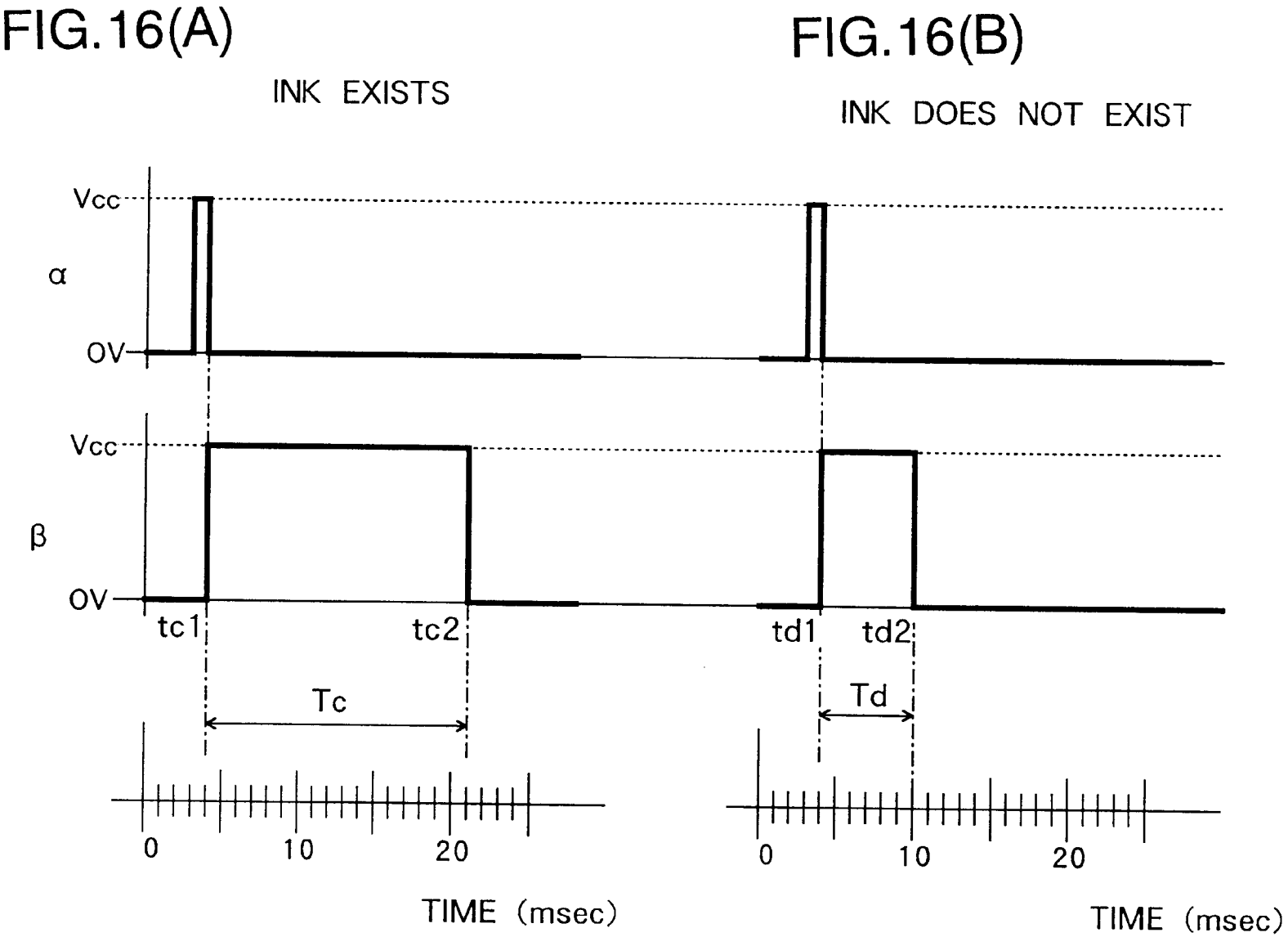
FIGS. 16A and 16B are timing charts indicating a relationship between the input signal input to a logic IC and the output signal when capacitance of the condenser changes corresponding to the residual ink quantity in the ink cartridge in the fourth embodiment.

Next, the detection circuit 50 of the fourth embodiment will be described with reference to FIG. 15, FIGS. 16(A) and 16(B). FIG. 15 shows a circuit diagram of the detection circuit of the fourth embodiment, FIGS. 16(A), 16(B) show a timing chart of input and output signals in the detection circuit. Here, the detection circuit of the fourth embodiment has basically the same construction as the detection circuit 50 in the third embodiment. Thus, in FIGS. 15, 16, as in the third embodiment, "α" indicates a measuring signal input from the CPU 31 as detection means, and "β" indicates a pulse signal input to the CPU 31, the pulse signal having a waveform on the basis of capacitance value (C) of the condenser which changes corresponding to the residual ink quantity in the ink cartridge and resistance value (R) of the timing resistor 73. The fourth embodiment is different from the third embodiment at the following point. That is, in the detection circuit in the fourth embodiment, there are arranged in the ink cartridge a pair of electrodes constructing a condenser in which capacitance value changes corresponding to the residual ink quantity and a timing resistor with a predetermined resistance value is connected, and further both the electrodes and the resistor construct a multivibrator circuit in cooperation with the logic IC. Remaining construction is as same as the third embodiment. Therefore, the fourth embodiment will be described by giving the same numbers to the same elements as in the third embodiment.

In the detection circuit 50 of the third embodiment, a multivibrator circuit is constructed from the condenser representing equivalently to capacitance of the ink cartridge 7, the timing resistor 73 and the logic IC 71. In the ink cartridge 7, the first electrode 82 and the second electrode 83 are arranged, and and capacitance value between the first and second electrodes 82, 83 changes according to the residual ink quantity. Corresponding to the change of the capacitance value, the detection circuit 50 outputs the detection signal β with rectangular waveform based on the input signal α.

As mentioned above, in the logic IC 71, when a resistor and a condenser are connected to Rx/Cx terminal and Cx terminal, the logic IC 71 has function to continue monostable mode for a predetermined time set by the resistor and condenser. This function of the logic IC 71 is well-known, thus its explanation will be omitted.

Operation of the detection circuit 50 will be described with reference to FIGS. 16(A), 16(B). In the detection circuit 50, when the measuring signal α with rectangular waveform is input, the logic IC 71 outputs the detection signal β at the trailing edge (tc1, td1) of the signal α. Here, the waveform of the detection signal β is determined on the basis of the capacitance value (C) of the condenser including the electrodes 82, 83 and the resistance value (R) of the timing resistor 73. For example, in case that enough ink is filled in the ink cartridge 7 and the capacitance value (C) of the condenser becomes large, the pulse width of the detection signal β output from the logic IC 71 is determined on the basis of the capacitance value (C1) of the condenser and resistance value (R) of the timing resistor 73, and becomes Tc (see FIG. 16(A)).

On the other hand, in case that the residual ink quantity decreases and the capacitance value (C) of the condenser becomes small, the pulse width of the detection signal β output from the logic IC 71 is determined on the basis of the capacitance value (C2) of the condenser and resistance value (R) of the timing resistor 73, and becomes Td (see FIG. 16(B)). Here, since the capacitance value (C2) of the condenser is smaller than the capacitance value (C1), the pulse width Td is narrower than the pulse width Tc.

In this way, the pulse width of the detection signal β changes on the basis of the capacitance value (C) of the condenser and the resistance value (R) of the timing resistor 73, corresponding to change of the capacitance value (C) in the condenser, that is, the residual ink quantity. At that time, the pulse width PW is determined by PW=CR. Therefore, the detection signal β can become the logic signal. As a result, the A/D converter, which is necessary for the conventional detection apparatus, the detection circuit 50 and construction of the interface can be simplified.

Figure 17:
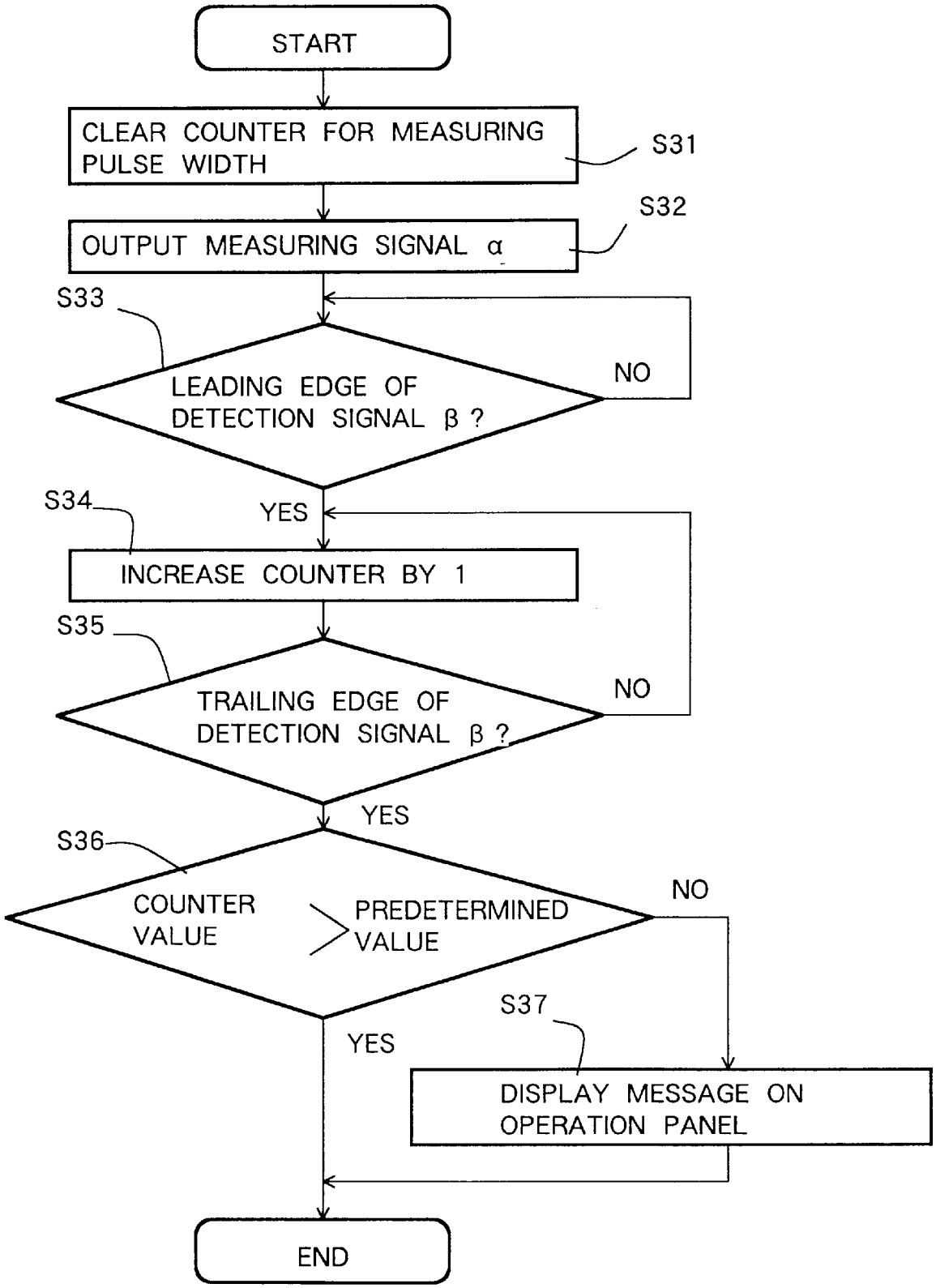
FIG. 17 is a flowchart for detecting the residual ink in the fourth embodiment
Figure 18:
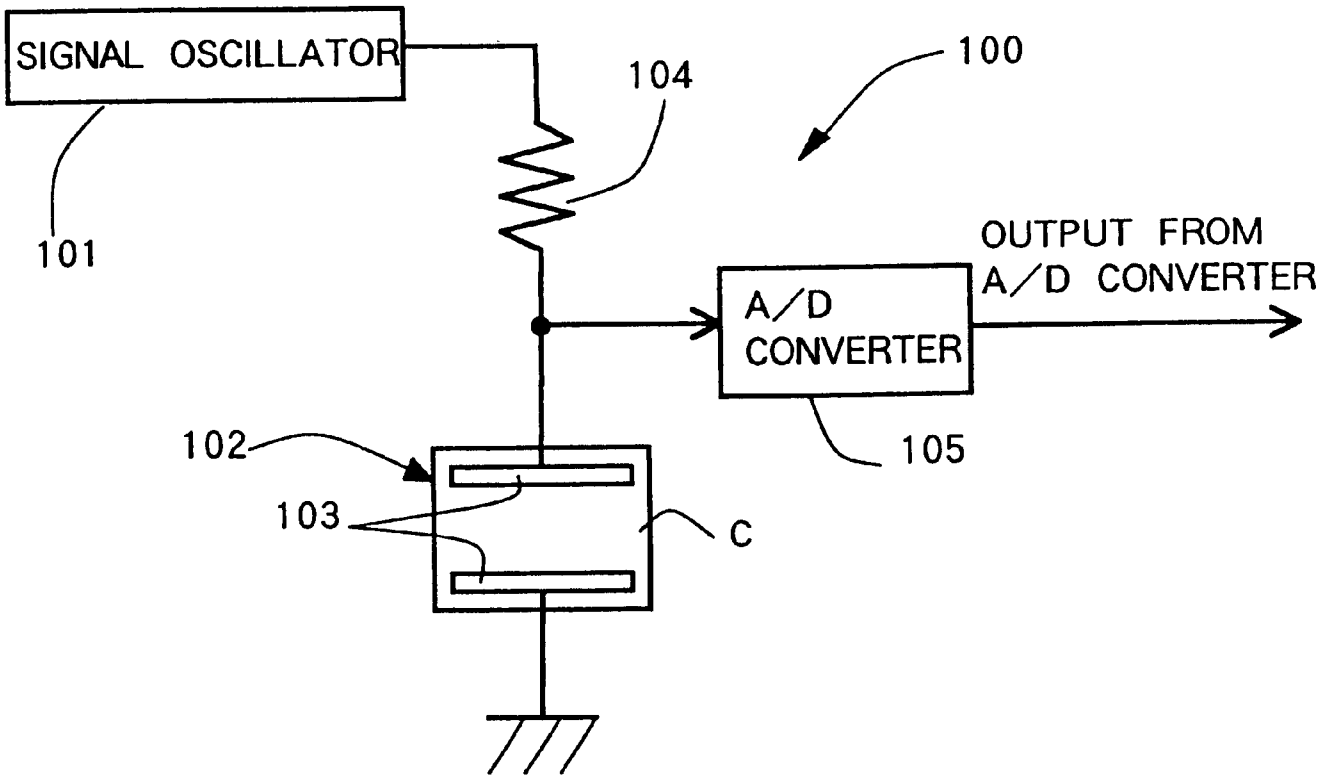
(PRIOR ART) FIG.18
FIG. 18 is a circuit diagram of the detection apparatus in the prior art.
Figures 19A, 19B:
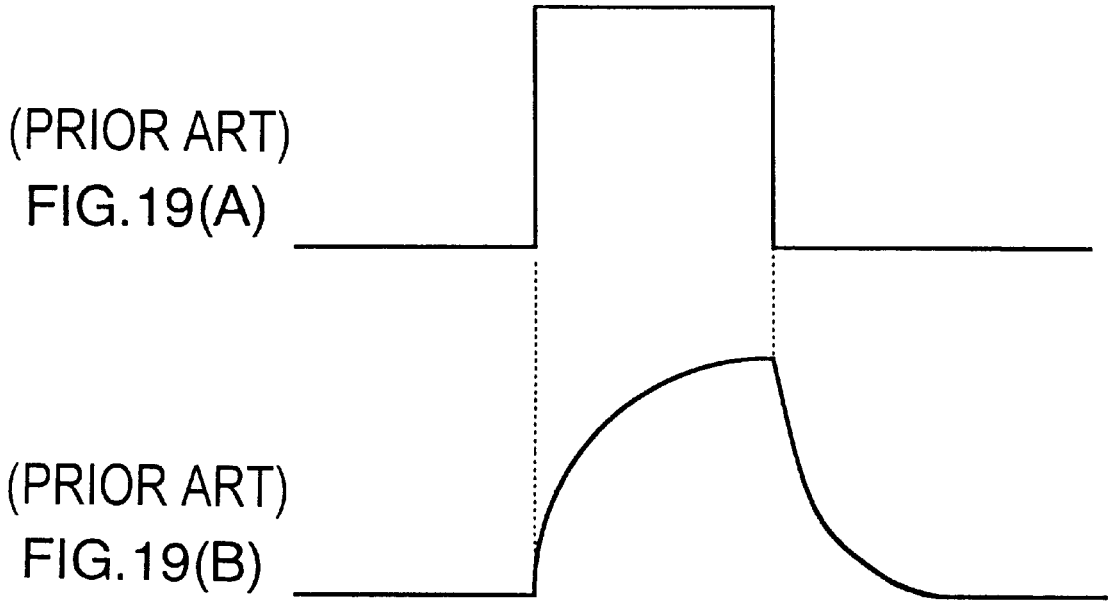
FIG.19(A) (PRIOR ART)
FIGS. 19A and 19B are views to explain the waveforms of the rectangular pulse and the detecting pulse in the detection apparatus in the prior art.

Operation of the above constructed detection circuit in the fourth embodiment will be described with reference to FIG. 17. In the operation, the CPU 31 judges whether the residual ink in the ink cartridge 7 is enough or not based on the detection signal β.

First, a counter formed in the RAM 36 is cleared in S31 by the CPU 31. In S32, the measuring signal α with rectangular pulse waveform is produced (see FIG. 16(A), the waveform of signal α, Tc1), then the CPU 31 waits until the leading edge of the signal β is detected (S33:NO). When the leading edge of the signal β is detected (S33:YES), the counter is increased by 1 (S34) and the CPU 31 waits until the trailing edge of the signal β is detected (S35:NO). Further, if the trailing edge of the signal β is detected (S35:YES), the counter value of the counter is compared with a predetermined value stored in the ROM 35 (S36). Here, for example, the predetermined value is set to 10,000. If the counter value of the counter is more than the predetermined value (S36:YES), program is terminated. On the other hand, if the counter value is not more than the predetermined value (S36:NO), it is displayed in S37 on the operation panel 44 a message "Ink in ink cartridge runs out.", and such message is informed to the user. The user can exchange the old ink cartridge 7 with a new one.

Operation of the detection circuit 50 will be described in detail with reference to FIGS. 16(A), 16(B). First, a case will be described in which the CPU 31 judges that the residual ink quantity in the ink cartridge 7 is enough. In FIG. 16(A), the measuring signal α is input (Tc1), and the detection signal β rises up based on the trailing edge of the signal α. After the logic IC 71 is retained under monostable state for a time determined by the resistance value (R) and the capacitance value (C1), the detection signal β trails (Tc2). At that time, the pulse width of the detection signal β is Tc which is 16 milli seconds (msec). If the time necessary for conducting processes in S34, S35 is 1 micro second, the counter value of the counter becomes 16,000. Therefore, since the counter value is larger than the predetermined value (10,000), judgement in S36 becomes "YES" and the residual ink in the ink cartridge 7 is enough for printing.

Next, it will be described a case that the CPU 31 judges that the residual ink quantity in the ink cartridge 7 runs out. In FIG. 16(B), the measuring signal α is input (Td1), and the detection signal β rises up based on the trailing edge of the signal α. After the logic IC 71 is retained under monostable state for a time determined by the resistance value (R) and the capacitance value (C2), the detection signal β trails (Td2). At that time, the pulse width of the detection signal β is Td which is 6 milli seconds (msec). If the time necessary for conducting processes in S34, S35 is 1 micro second, the counter value of the counter becomes 6,000. Therefore, since the counter value is smaller than the predetermined value (10,000), judgement in S36 becomes "NO". Thus, it concludes that the residual ink quantity in the ink cartridge 7 decreases and it is the time to exchange the old ink cartridge 7 with a new one. Therefore, the message "Ink in ink cartridge runs out." is displayed on the operation panel 44 and such message is informed to the user.

As mentioned above, in the detection circuit 50 of the fourth embodiment, the detection signal β with the pulse width which changes corresponding to the residual ink quantity can be obtained by the multivibrator circuit constructed from the condenser in which the capacitance value changes according to the residual ink quantity, the timing resistor 73 and the logic IC 71. Further, the residual ink quantity is detected by measuring the pulse width of the detection signal β output from the multivibrator circuit.

Therefore, digital processing can be conducted by directly using the logic signals output from the logic IC 71, without using the A/D converter. Thereby, the detection apparatus for detecting the residual ink quantity in the ink cartridge 7 can be simply constructed, and the apparatus can be realized with low cost and compact size.

Further, the multivibrator circuit in the detection circuit 50 is constructed from the electrodes 82, 83 arranged in the ink cartridge 7, the timing resistor 73 and logic IC 71. Thus, circuit construction can be miniaturized and can be realized without particularly changing the control circuit of the ink jet printer. Since highly efficient elements and circuit are not used in the detection circuit 50, such circuit 50 can be installed in the control device of the ink jet printer.

While the invention has been particularly shown and described with reference to preferred embodiments thereof, it will be understood by those skilled in the art that the foregoing and other changes in form and details can be made therein without departing from the spirit and scope of the invention.

For example, in the third and fourth embodiments, though the multivibrator circuit is constructed from the resistor, the condenser and the logic IC, various circuits constructing monostable multivibrator can be applied to the detection circuit.

In the embodiments, though the detection circuit is utilized for detecting the residual ink quantity in the ink cartridge, the detection circuit can be applied for detecting residual quantity of liquid other than the ink. Further, the detection circuit may be constructed so as to detect the residual ink quantity step by step according to the pulse width of the detection signal.

What is claimed is:

1. A detection apparatus for detecting residual ink quantity in an ink cartridge supplying ink to an ink jet head, the detection apparatus comprising:

pulse oscillation means for oscillating a pulse signal with a frequency which changes corresponding to the residual ink quantity, the pulse oscillation means including a CR oscillation circuit having a condenser in which a capacitance changes corresponding to the residual ink quantity in the ink cartridge; and detection means for detecting the residual ink quantity on the basis of the oscillating frequency of the pulse signal while receiving the pulse signal produced in the pulse oscillation means.

2. The detection apparatus according to claim 1, wherein the pulse oscillation means comprises a self-oscillating oscillation circuit.

3. The detection apparatus according to claim 1, wherein the condenser in the CR oscillation circuit comprises a pair of electrodes arranged in the ink cartridge, the electrodes constructing the condenser in cooperation with the ink in the ink cartridge.

4. The detection apparatus according to claim 3, wherein the CR oscillation circuit has a timing resistor connected to one of the electrodes and a logic IC connected parallel to the timing resistor.

5. The detection apparatus according to claim 4, wherein the logic IC outputs the pulse signal corresponding to an input signal which has a waveform determined on the basis of a capacitance value of the condenser and a resistance value of the timing resistor when the input signal is input to the logic IC.

6. The detection apparatus according to claim 5, further comprising a current restriction resistor connected to an input side of the logic IC, the current restriction resistor protecting the logic IC.

7. The detection apparatus according to claim 4, wherein the condenser and the timing resistor constructs a CR time constant circuit.

8. The detection apparatus according to claim 5, wherein the waveform of the input signal becomes a rounded waveform with a comparatively long cycle when the residual ink quantity is enough in the ink cartridge.

9. The detection apparatus according to claim 5, wherein the waveform of the input signal becomes a waveform with a short cycle in which its round is reduced when the residual ink quantity decreases in the ink cartridge.

10. The detection apparatus according to claim 4, wherein the frequency of the pulse signal f is determined by f=1/CR.

11. The detection apparatus according to claim 1, wherein the detection means further comprises;

count means for counting a pulse number in the pulse signal for a predetermined time;

comparison means for comparing the pulse number counted by the count means with a predetermined value; and judgement means for judging whether the residual ink quantity is enough in the ink cartridge on the basis of a comparison result by the comparison means.

12. The detection apparatus according to claim 11, further comprising information means for informing running out of the residual ink quantity on the basis of judgement by the judgement means.

13. A detection apparatus for detecting residual ink quantity in an ink cartridge supplying ink to an ink jet head, the detection apparatus comprising:

pulse oscillation means for oscillating a pulse signal with a frequency which changes corresponding to the residual ink quantity, the pulse oscillation means including a CR oscillation circuit having a resistor in which a resistance changes corresponding to the residual ink quantity in the ink cartridge; and detection means for detecting the residual ink quantity on the basis of the oscillating frequency of the pulse signal while receiving the pulse signal produced in the pulse oscillation means.

14. The detection apparatus according to claim 13, wherein the pulse oscillation means comprises a self-oscillating oscillation circuit.

15. The detection apparatus according to claim 13, wherein the resistor in the CR oscillation circuit comprises a pair of electrodes arranged in the ink cartridge, the electrodes constructing the resistor in cooperation with the ink in the ink cartridge.

16. The detection apparatus according to claim 15, wherein the CR oscillation circuit has a timing condenser connected to one of the electrodes and a logic IC connected parallel to the timing condenser.

17. The detection apparatus according to claim 16, wherein the logic IC outputs the pulse signal corresponding to an input signal which has a waveform determined on the basis of a resistance value of the resistor and a capacitance value of the timing condenser when the input signal is input to the logic IC.

18. The detection apparatus according to claim 17, further comprising a current restriction resistor connected to an input side of the logic IC, the current restriction resistor protecting the logic IC.

19. The detection apparatus according to claim 17, wherein the waveform of the input signal becomes a waveform with a short cycle in which its round is reduced when the residual ink quantity is enough in the ink cartridge.

20. The detection apparatus according to claim 17, wherein the waveform of the input signal becomes a rounded waveform with a comparatively long cycle when the residual ink quantity decreases in the ink cartridge.

21. The detection apparatus according to claim 16, wherein the resistor and the timing condenser constructs a CR time constant circuit.

22. The detection apparatus according to claim 16, wherein the frequency of the pulse signal f is determined by f=1/CR.

23. The detection apparatus according to claim 13, wherein the detection means further comprises;

count means for counting a pulse number in the pulse signal for a predetermined time;

comparison means for comparing the pulse number counted by the count means with a predetermined value; and judgement means for judging whether the residual ink quantity is enough in the ink cartridge on the basis of a comparison result by the comparison means.

24. The detection apparatus according to claim 23, further comprising information means for informing running out of the residual ink quantity on the basis of judgement by the judgement means.

25. A detection apparatus for detecting residual ink quantity in an ink cartridge supplying ink to an ink jet head, the detection apparatus comprising:

pulse product means for producing a pulse signal with a pulse width which changes corresponding to the residual ink quantity on the basis of an input signal, the pulse product means including a multivibrator circuit having a resistor in which a resistance changes corresponding to the residual ink quantity in the ink cartridge; and detection means for applying the input signal to the pulse product means and for receiving the pulse signal output from the pulse product means, the detection means detecting the residual ink quantity on the basis of the pulse width of the pulse signal.

26. The detection apparatus according to claim 25, wherein the resistor in the multivibrator circuit comprises a pair of electrodes arranged in the ink cartridge, the electrodes constructing the resistor in cooperation with the ink in the ink cartridge.

27. The detection apparatus according to claim 26, wherein the multivibrator circuit has a timing condenser connected to one of the electrodes and a logic IC connected to the timing condenser.

28. The detection apparatus according to claim 27, wherein the logic IC outputs the pulse signal which has a waveform determined on the basis of a resistance value of the resistor and a capacitance value of the timing condenser when the input signal is input to the logic IC.

29. The detection apparatus according to claim 28, wherein the pulse width of the pulse signal becomes narrow when the residual ink quantity is enough in the ink cartridge and the resistance value of the resistor is small.

30. The detection apparatus according to claim 28, wherein the pulse width of the pulse signal becomes wide when the residual ink quantity decreases in the ink cartridge and the resistance value of the resistor is large.

31. The detection apparatus according to claim 27, wherein the pulse width PW of the pulse signal is determined by PW=CR.

32. The detection apparatus according to claim 25, wherein the detection means further comprises;

measurement means for measuring a pulse time corresponding to the pulse width;

comparison means for comparing the pulse time measured by the measurement means with a predetermined value; and judgement means for judging whether the residual ink quantity is enough in the ink cartridge on the basis of a comparison result by the comparison means.

33. The detection apparatus according to claim 32, further comprising information means for informing running out of the residual ink quantity on the basis of judgement by the judgement means.

34. A detection apparatus for detecting residual ink quantity in an ink cartridge supplying ink to an ink jet head, the detection apparatus comprising:

pulse product means for producing a pulse signal with a pulse width which changes corresponding to the residual ink quantity on the basis of an input signal, the pulse product means including a multivibrator circuit having a condenser in which a capacitance changes corresponding to the residual ink quantity in the ink cartridge; and detection means for applying the input signal to the pulse product means and for receiving the pulse signal output from the pulse product means, the detection means detecting the residual ink quantity on the basis of the pulse width of the pulse signal.

35. The detection apparatus according to claim 34, wherein the condenser in the multivibrator circuit comprises a pair of electrodes arranged in the ink cartridge, the electrodes constructing the condenser in cooperation with the ink in the ink cartridge.

36. The detection apparatus according to claim 35, wherein the multivibrator circuit has a timing resistor connected to one of the electrodes and a logic IC connected to the timing resistor.

37. The detection apparatus according to claim 36, wherein the logic IC outputs the pulse signal which has a waveform determined on the basis of a capacitance value of the condenser and a resistance value of the timing resistor when the input signal is input to the logic IC.

38. The detection apparatus according to claim 37, wherein the pulse width of the pulse signal becomes wide when the residual ink quantity is enough in the ink cartridge and the capacitance value of the condenser is large.

39. The detection apparatus according to claim 37, wherein the pulse width of the pulse signal becomes narrow when the residual ink quantity decreases in the ink cartridge and the capacitance value of the condenser is small.

40. The detection apparatus according to claim 36, wherein the pulse width PW of the pulse signal is determined by PW=CR.

41. The detection apparatus according to claim 34, wherein the detection means further comprises;

measurement means for measuring a pulse time corresponding to the pulse width;

comparison means for comparing the pulse time measured by the measurement means with a predetermined value; and judgement means for judging whether the residual ink quantity is enough in the ink cartridge on the basis of a comparison result by the comparison means.

42. The detection apparatus according to claim 41, further comprising information means for informing running out of the residual ink quantity on the basis of judgement by the judgement means.

* * * * *